US005169247A

United States Patent [19]

Asano et al.

[11] Patent Number: 5,169,247

[45] Date of Patent: Dec. 8, 1992

[54] THERMAL PRINTER WITH BIAXIAL MOTOR FEED OF THE CARRIAGE AND RIBBON

[75] Inventors: Shinya Asano, Tokyo; Noboru Shimoyama, Yokohama; Ritsuo Machii, Tokyo, all of Japan

[73] Assignee: Canon Kabushiki Kaisha, Tokyo, Japan

[21] Appl. No.: 762,254

[22] Filed: Sep. 19, 1991

Related U.S. Application Data

[63] Continuation of Ser. No. 359,856, May 31, 1989, abandoned.

[30] Foreign Application Priority Data

| | | | |
|---|---|---|---|
| Jun. 2, 1988 | [JP] | Japan | 63-073736[U] |
| Jun. 2, 1988 | [JP] | Japan | 63-073737[U] |
| Jun. 2, 1988 | [JP] | Japan | 63-073738[U] |
| Jun. 2, 1988 | [JP] | Japan | 63-073739[U] |
| Jun. 2, 1988 | [JP] | Japan | 63-073740[U] |
| Jun. 2, 1988 | [JP] | Japan | 63-073741[U] |
| Jun. 2, 1988 | [JP] | Japan | 63-136079 |
| Jun. 2, 1988 | [JP] | Japan | 63-136080 |
| Jun. 2, 1988 | [JP] | Japan | 63-136081 |
| Jun. 2, 1988 | [JP] | Japan | 63-136082 |

[51] Int. Cl.[5] ..... B41J 23/34

[52] U.S. Cl. ..... 400/185; 400/120; 400/208

[58] Field of Search ..... 400/709.1, 120, 185-187, 400/223, 225, 314.1, 314.3, 315, 317, 317.1, 319-320.1, 335, 192, 53, 58, 208

[56] References Cited

U.S. PATENT DOCUMENTS

| | | | |
|---|---|---|---|
| 4,397,576 | 8/1983 | Drejza et al. | 400/120 |
| 4,443,125 | 4/1984 | Hirano | 400/120 |
| 4,444,521 | 4/1984 | Rickard et al. | 400/120 |
| 4,468,139 | 8/1984 | Hattori | 400/120 |
| 4,563,692 | 1/1986 | Negita et al. | 400/120 |
| 4,575,733 | 3/1986 | Hattori et al. | 400/120 |
| 4,595,936 | 6/1986 | Nakajima et al. | 400/120 |
| 4,598,301 | 7/1986 | Suzaki et al. | 400/208 |
| 4,611,937 | 9/1986 | Sato et al. | 400/208 |
| 4,620,199 | 10/1986 | Tatsumi et al. | 400/120 |
| 4,652,154 | 3/1987 | Horiya et al. | 400/208 |
| 4,723,853 | 2/1988 | Suzaki et al. | 400/120 |
| 4,772,898 | 9/1988 | Noda | 400/124 |
| 4,775,869 | 10/1988 | Minowa | 400/185 |
| 4,798,487 | 1/1989 | Hattori et al. | 400/223 |
| 4,822,186 | 4/1989 | Hanaoka et al. | 400/185 |
| 4,913,567 | 4/1990 | Imamaki et al. | 400/120 |
| 4,919,553 | 4/1990 | Ueno et al. | 400/120 |
| 4,921,363 | 5/1990 | Nishihara et al. | 400/120 |

FOREIGN PATENT DOCUMENTS

| | | | |
|---|---|---|---|
| 3614248 | 10/1987 | Fed. Rep. of Germany | 400/709.1 |
| 61-137789 | 6/1986 | Japan . | |
| 62-156994 | 7/1987 | Japan . | |

*Primary Examiner*—Eugene H. Eickholt

*Attorney, Agent, or Firm*—Fitzpatrick, Cella, Harper & Scinto

[57] ABSTRACT

An image recording apparatus for recording an image on a recording sheet includes a recording head for recording the image on the recording sheet, a carriage for holding the recording head, the carriage being reciprocated along a convey route of the recording sheet, a motor for applying a drive force for conveying the recording sheet and a drive force for causing the recording head to move between a recording position where the recording head performs image recording and a retracted position where the recording head is retracted from the recording position, and a control unit for controlling the motor to switch between conveying the recording sheet and moving the recording head in accordance with movement of the carriage.

13 Claims, 20 Drawing Sheets

THERMAL PRINTER WITH BIAXIAL MOTOR FEED OF THE CARRIAGE AND RIBBON

This application is a continuation of application Ser. No. 07/359,856 filed May 31, 1989, now abandoned.

BACKGROUND OF THE INVENTION:

1. Field of the Invention

The present invention relates to an image recording apparatus for recording an image on a recording medium.

Image recording apparatuses include a printer, an electronic printer, a facsimile machine, and a copying machine.

2. Related Background Art

A conventional image recording apparatus known as a printer and an electronic typewriter is available wherein a recording head is mounted on a carriage which is reciprocated along a platen in a printing direction. The recording head is moved in synchronism with movement of the carriage and forms an image consisting of a dot matrix on a recording sheet on the basis of printing data. When one-line recording is completed, the recording sheet is fed by a one-line pitch, and recording of the next line is then performed. When one-page recording is completed, the recording sheet is fed and exhausted.

In a conventional thermal recording apparatus, recording is performed while a thermal head is moved in tight contact with a sheet. The recording apparatus of this type includes a thermal head up/down mechanism.

In another conventional thermal transfer recording apparatus, an ink ribbon cassette can be replaceably mounted on a carriage. During recording (in the head-down state), the ink ribbon is fed to the front surface of a recording head at a velocity corresponding to a carriage moving velocity.

In this conventional image recording apparatus, an up/down operation of a thermal head and feeding of a recording sheet are performed by a single motor.

In each of these image recording apparatuses, it is difficult to switch from a printing function to a recording sheet feed function during printing. Only when the thermal head is located at its home position (e.g., the left end position), the mode can be switched to the sheet feed function, thus requiring a long mode switching time.

In still another conventional image recording apparatus of this type, carriage movement and a take-up operation of the ink ribbon (or an ink sheet) is performed by a single motor.

With this arrangement, a gear for transmitting a drive force of the motor to an ink ribbon take-up shaft is disposed in a displacement member which is coaxial with the take-up shaft.

With the above arrangement, extra parts such as a gear must be used to align a carriage moving direction with a ribbon take-up direction.

SUMMARY OF THE INVENTION

It is an object of the present invention to provide an image recording apparatus capable of providing a plurality of functions with a single motor.

It is another object of the present invention to provide an image recording apparatus capable of causing a single motor to perform both displacement (e.g., an up/down operation) of a recording head and feeding of a recording sheet.

It is still another object of the present invention to provide an image recording apparatus capable of causing a single motor to drive a recording head along a recording medium convey route and to drive a take-up operation of an ink sheet.

It is still another object of the present invention to provide an image recording apparatus capable of solving the conventional problems described above, switching a mode of the apparatus to a sheet convey function at any position of a thermal head, and increasing the recording speed upon quick switching of the mode by a single motor.

It is still another object of the present invention to provide a compact image recording apparatus which can solve the conventional problems described above and in which a smaller number of components are required.

BRIEF DESCRIPTION OF THE DRAWINGS

FIGS. 3A and 3B are views showing a power switching mechanism of a head motor in the image recording apparatus shown in FIG. 1, in which FIG. 3A is a plan view showing an up/down drive state of the head, and FIG. 3B is a plan view showing feeding of a recording sheet;

DETAILED DESCRIPTION OF THE PREFERRED EMBODIMENT

A preferred embodiment of the present invention will be described with reference to the accompanying drawings.

Figure 24:
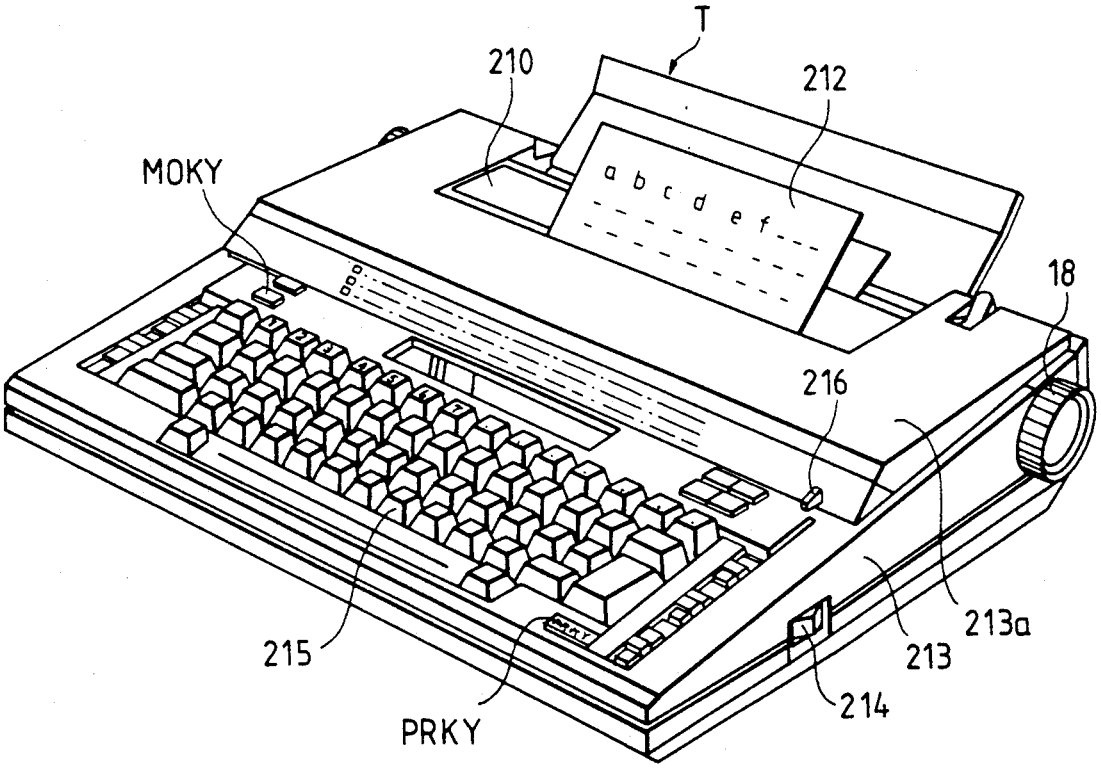
FIG. 24 is a perspective view showing an outer appearance of an electronic typewriter which employs the present invention.

FIG. 24 is a perspective view showing an outer appearance of a typewriter T as an image recording apparatus according to an embodiment of the present invention.

Referring to FIG. 24, the typewriter T includes a platen 210, a case 213, a power switch 214 for ON/-OFF-controlling a power source, and a keyboard 215. A recording sheet (i.e., a recording medium such as a paper sheet or a plastic thin plate) 212 is loaded on the platen 210.

A hood switch 216 is turned on/off upon opening/-closing of a hood 213*a* to detect opening/closing of the hood 213*a*.

The keyboard 215 includes a mode key MOKY used to selectively set various modes such as a ribbon mode (to be described later).

The keyboard 215 also includes a printing command key PRKY.

The typewriter T also incorporates a printing unit (recording unit), an input unit, a display unit, a control unit, an external I/O interface, and the like.

The typewriter T need not include the input unit or the display unit.

Figure 1:
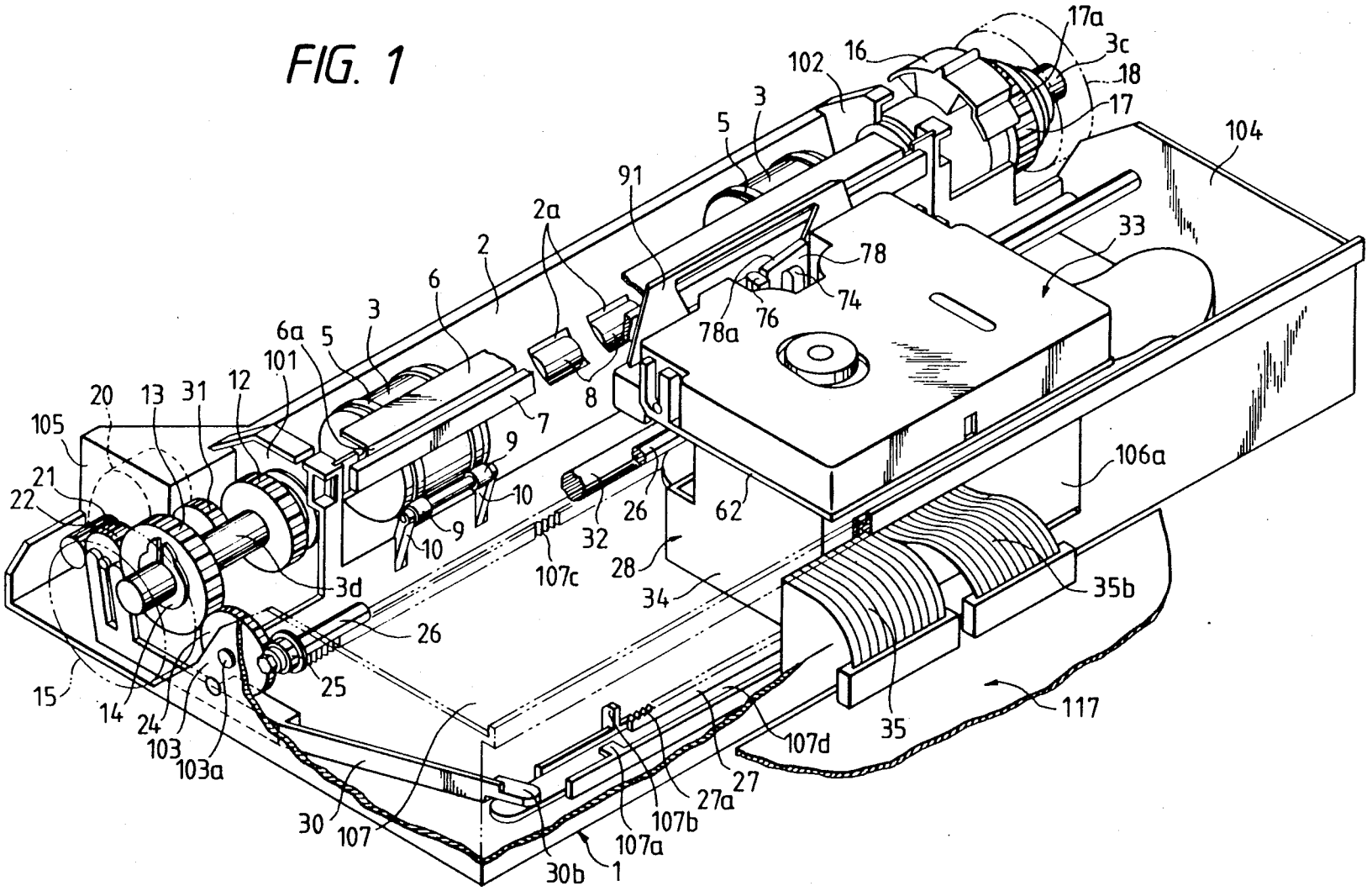
FIG. 1 is a schematic perspective view showing a structure of an image recording apparatus according to an embodiment of the present invention.

FIG. 1 is a perspective view showing the internal main part of the image recording apparatus which employs the present invention.

A so-called self correction ink sheet cassette, a two-color printing ink sheet cassette, and a normal monochromatic ink sheet cassette can be loaded in this image recording apparatus (e.g., a printer a typewriter). The ink sheet properties can be sufficiently utilized to perform single-color recording, two-color recording, and recording correction.

The apparatus includes a housing base 1, a left side plate 101, a right side plate 102, a gear seat left side plate 103, a gear seat right side plate 104, and a head motor mounting plate 105.

A shaft 101*a* for holding a PF reduction gear (to be described later) extends from the left side plate 101. A shaft 103*a* for supporting an intermediate gear II 24 (to be described later) is disposed on the gear seat left side plate 103. A guide hole for supporting a torque shaft 26 and a torque shaft gear 25 (both of which will be described later), and a guide hole for holding a carriage shaft 32 are formed/disposed in the gear seat left side plate 103.

A guide hole for supporting the torque shaft 26 (to be described later), a guide hole for holding the carriage shaft 32, and a screw hole 104*c* for preventing removal of the carriage shaft 32 are formed in the gear seat right side plate 104.

A shaft 105*a* for holding a selection gear 22 and a selection gear spring 23 (both of which will be described later) is mounted on the head motor mounting plate 105. Head motor mounting screw holes, and a hole through which a pinion 21 of a head motor 20 extends are formed in the head motor mounting plate 105.

A groove is formed in the front side of the base 1 to hold a flexible cable (FPC) 35.

The flexible cable (FPC) 35 is used to transmit signals to a carriage 28 or removes charge from the ink ribbon.

The signals are a heating control signal for a thermal head 78, a drive control signal for a carriage motor 45, and ON/OFF detection signals of a home position sensor 49.

In this embodiment, the charge of the ink ribbon is removed by the FPC 35 through a ground circuit in a circuit board 117 (this charge removal will be described in detail later).

A guide rail 107*d* along which a roller 54 of the carriage is in slidable contact, a floating prevention portion 107*a* of a clutch rack 27, and a boss 107*b* for detecting a left limiter are disposed on a bottom plate 107 of the base 1.

A rack 107*c* is formed at a predetermined position of the base 1 along a printing digit direction (recording direction). The rack 107*c* is meshed with a carriage idler gear 64 of the carriage 28.

A paper pan 2 is formed integrally with the base 1, and six openings 2*a* for receiving pinch rollers 8 are formed at predetermined positions of the paper pan 2.

Figure 3B:
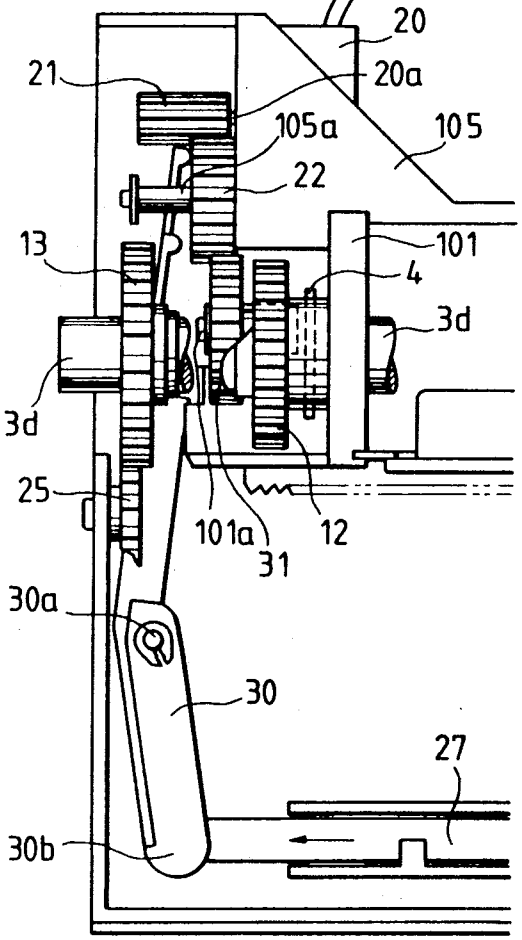
Figure 3A:
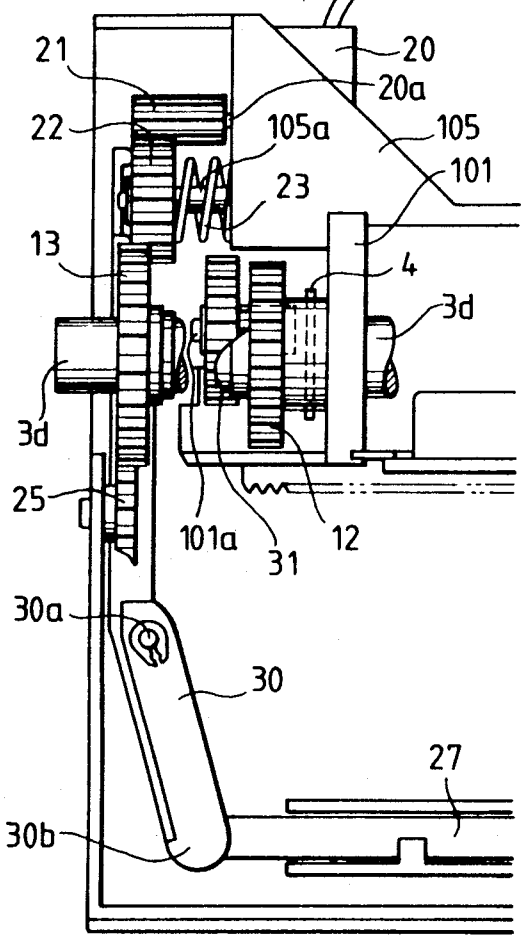

Paper feed rollers (PF rollers) 3 are made of a plastic material such as polycarbonate or ABS resin. A release lever 16 (to be described later) is mounted on a guide shaft 3*c* at an end of one of the paper feed rollers 3. A paper feed gear 12 is mounted on a guide shaft 3*d* at the other of the paper feed rollers 3 through a spring pin 4 (FIGS. 3A and 3B). The release lever 16 and the paper feed gear 12 are rotatably supported by the left and right side plates 101 and 102, respectively.

Paper feed rubber (PF rubber) members 5 are mounted on the paper feed rollers 3, respectively, and are spaced part from each other at predetermined positions. The rubber bands are mounted on each paper feed rubber member 5. In this embodiment, six paper feed rubber members 5 are used.

A platen holder 6 is held between the left and right side plates 101 and 102. A convex bent portion 6*a* is formed at the lower portion of the holder 6 to oppose a gap between the paper feed (PF) rollers 3 and the paper feed rubber members 5.

A platen 7 obtained by coating a Teflon sheet on CR rubber is adhered to the front surface of the platen holder 6, i.e., at a position opposite to the thermal or recording head 78.

The platen 7 holds the recording sheet 212 at a predetermined position during recording with the recording head 78.

Pinch rollers 8 are brought into tight contact with three paper feed rubber members 5 and are lined with rubber so as to firmly catch the distal end of the recording sheet 212 during insertion of the recording sheet 212.

Columnar front rollers 9 are disposed such that their outer surfaces are brought into contact with the paper feed rubber members 5.

The pair of front rollers 9 are rotatably supported by support arms 10 pivotal about a shaft 10*a* and are urged against the rubber member 5 by a pinch spring 11 (FIG.

2). The pinch spring 11 is made of a single leaf spring which also urges the central portion of the pinch roller 8. More specifically, the spring 11 is a U-shaped spring whose elastic force acts in a closing direction. A portion 11*a* of the spring 11 is mounted on the base 1. One end 11*b* of the spring 11 urges the roller 8, and the other end 11*c* urges a rib 10*b* of the arm 10.

The paper feed gear (PF gear) 12 is mounted on a rotating shaft 3*d* of the paper feed roller (PF roller) 3 and is rotated therewith.

An intermediate gear I 13 is coaxially rotated about the shaft 3*d* of the PF roller 3.

A stop ring 14 is mounted on the intermediate gear I 13 and defines movement of the intermediate gear I 13 in the thrust direction.

A paper feed left knob 15 is mounted integrally with the PR roller 3. Upon manual operation of the knob 15, the roller 3 can be rotated in the forward or reverse direction.

The release lever 16 is rotatably fitted on the shaft 3*c* of the PR roller 3 and is also rotatably mounted on the right side plate 102.

Upon operation of a knob 16*a* (FIG. 4), the paper release mechanism is operated. The pinch rollers 8 and the front rollers 9 are released from the PF rollers (driving rollers) 3, so that the recording sheet 212 can be freely moved.

Figure 2:
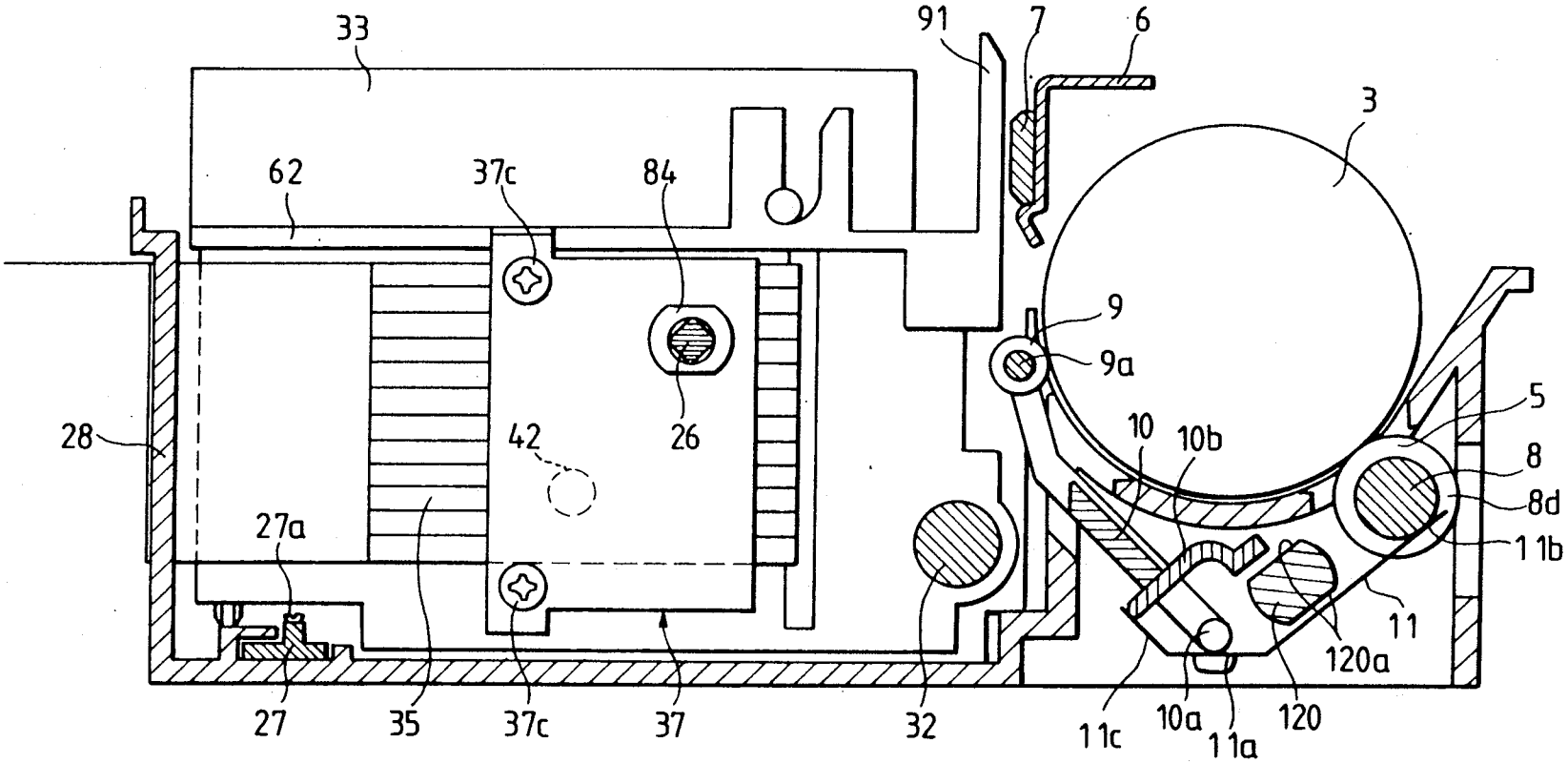
FIG. 2 is a longitudinal sectional view showing the right side of a carriage in the image recording apparatus shown in FIG. 1.

The longitudinal sectional view of the image recording apparatus of FIG. 2 illustrates operating portions of the paper release mechanism, i.e., sections of the pinch and front rollers 8 and 9 for applying a sheet convey force, the leaf spring 11, and a release shaft 120.

Figure 4:
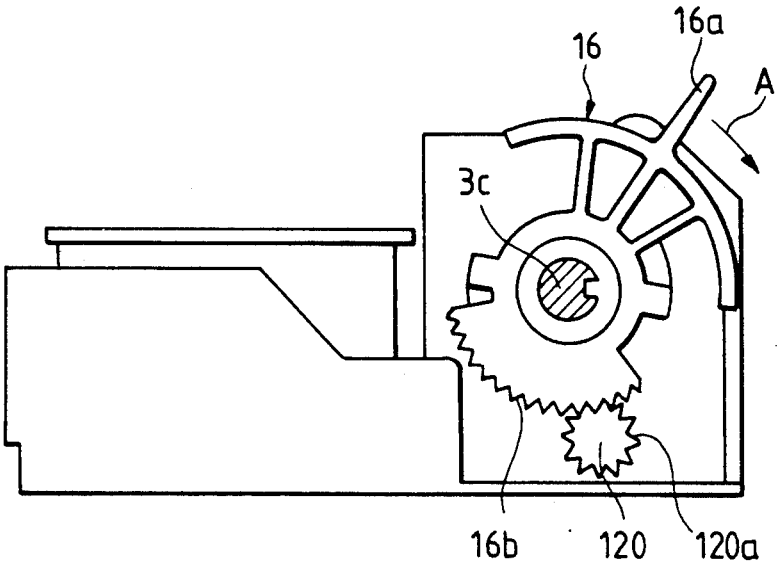
FIG. 4 is a side view showing a release mechanism of a sheet feeding means in FIG. 1.

The right sectional view of FIG. 4 illustrates manual operation portions of the paper release mechanism, i.e., the release lever 16 having the knob 16*a* and a gear 16*b*, and the release shaft 120 having a gear 120*a* meshed with the gear 16*b*. Upon rotation of the release lever 16 in a direction indicated by arrow A, the release shaft 120 transmits a release torque for actuating the leaf spring 11 and the support arm 10 against the elastic force of the leaf spring 11.

Figure 25:
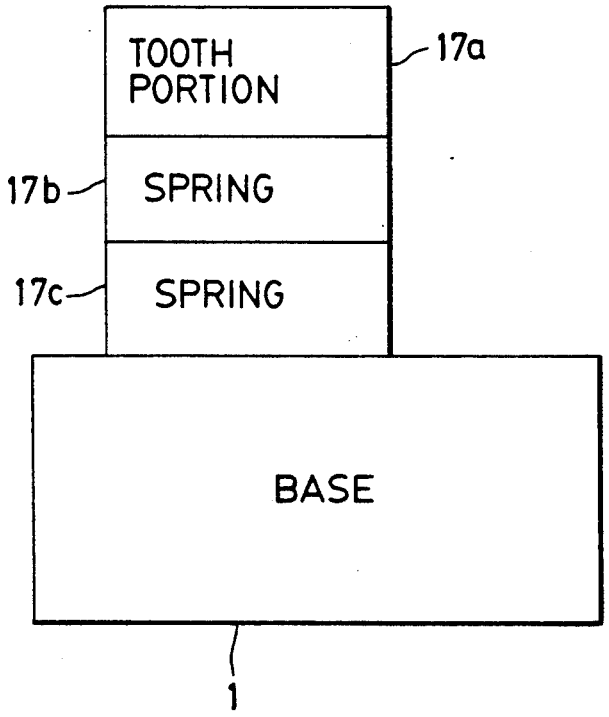
FIG. 25 is a schematic view showing a spring biasing tooth portion 17*a* of gear 17.

A variable gear (not shown), a detent gear 17, and a right sheet feed knob 18 are coaxially mounted on the shaft 3*a* of the PF roller 3 in the same manner as in the release lever 16. This variable gear (not shown) is fixed to the shaft 3*d* of the PF roller 3 by a spring pin (not shown). The detent gear 17 has a detent tooth portion 17*a* on its circumferential surface and is rotated together with the PF roller 3. A detent spring 17*b* urged against the tooth portion 17*a* of the detent gear 17 is fixed on the base 1 of the recording apparatus by a spring 17*c* as shown in FIG. 25. The angular position of the detent gear 17 is accurately detected by this detent spring, thus obtaining a stable position of the PF roller 3.

The sheet feed knob 18 is mounted integrally with the right end portion of the PF roller 3. Upon manual operation of the knob 18 or the left knob 15, the PF roller 3 can be rotated.

The motor 20 is fixed on the base 1 by two screws. The pinion 21 mounted on a rotating shaft 20*a* of the head motor 20 is always meshed with the selection gear 22 rotatably mounted on the shaft 105*a* of the head motor mounting plate 105 (FIG. 3). The selection gear 22 is slidable in the axial direction and is urged to a position where it is normally meshed with the intermediate gear I 13 by the selection gear spring 23. Rotation of the intermediate gear I 13 is not transmitted to the PF roller 3 but to the intermediate gear II 24. The intermediate gear II 24 is supported on the gear seat left side plate 103, and a rotational force is transmitted to the torque shaft 26 through the rotational torque shaft gear 25 by the intermediate gear II 24.

The clutch rack 27 is slidable along the printing direction by means of lever 30 as shown in FIGS. 3A and 3B. Teeth 29*a* of a clutch rack lever 29 of the carriage 28 can be meshed with rack teeth 27*a* of the clutch rack 27. These teeth are actually meshed during feeding of the recording sheet.

A selection lever 30 is mounted at an axis 30*a* on the bottom plate 107 of the base 1. One end 30*b* of the selection lever 30 is connected to the clutch rack 27. When the teeth 29*a* of the clutch rack lever 29 of the carriage 28 are meshed with the clutch rack 27, the carriage 28 is slightly moved to the left. Therefore, the selection lever 30 is moved from a state of FIG. 3A to a state of FIG. 3B. The selection gear 22 is slid to the right by the distal end of the selection lever 30 against the biasing force of the spring 23. A PF reduction gear 31 is meshed with the selection gear 22. The PF reduction gear 31 is a two-step gear. A large-diameter gear is meshed with the selection gear 22, and a small-diameter gear is meshed with the PF gear 12.

Upon movement of the selection gear 22 against the spring 23 to the right, a rotational force of the head motor 20 is transmitted to the PF rollers 3, and the recording sheet 212 is fed. In this case, since the selection gear 22 is kept separated from the intermediate gear I 13, rotation is not transmitted to the torque shaft 26.

The carriage 28 is guided and supported by the rail 107*d* disposed on the base 1 and the carriage shaft 32 and is slidably moved along the printing direction (i.e., a direction along the platen 7). An ink sheet cassette 33 (to be described later) is mounted on the carriage 28.

An internal structure of the carriage 28 will be described with reference to FIG. 5.

Figure 5:
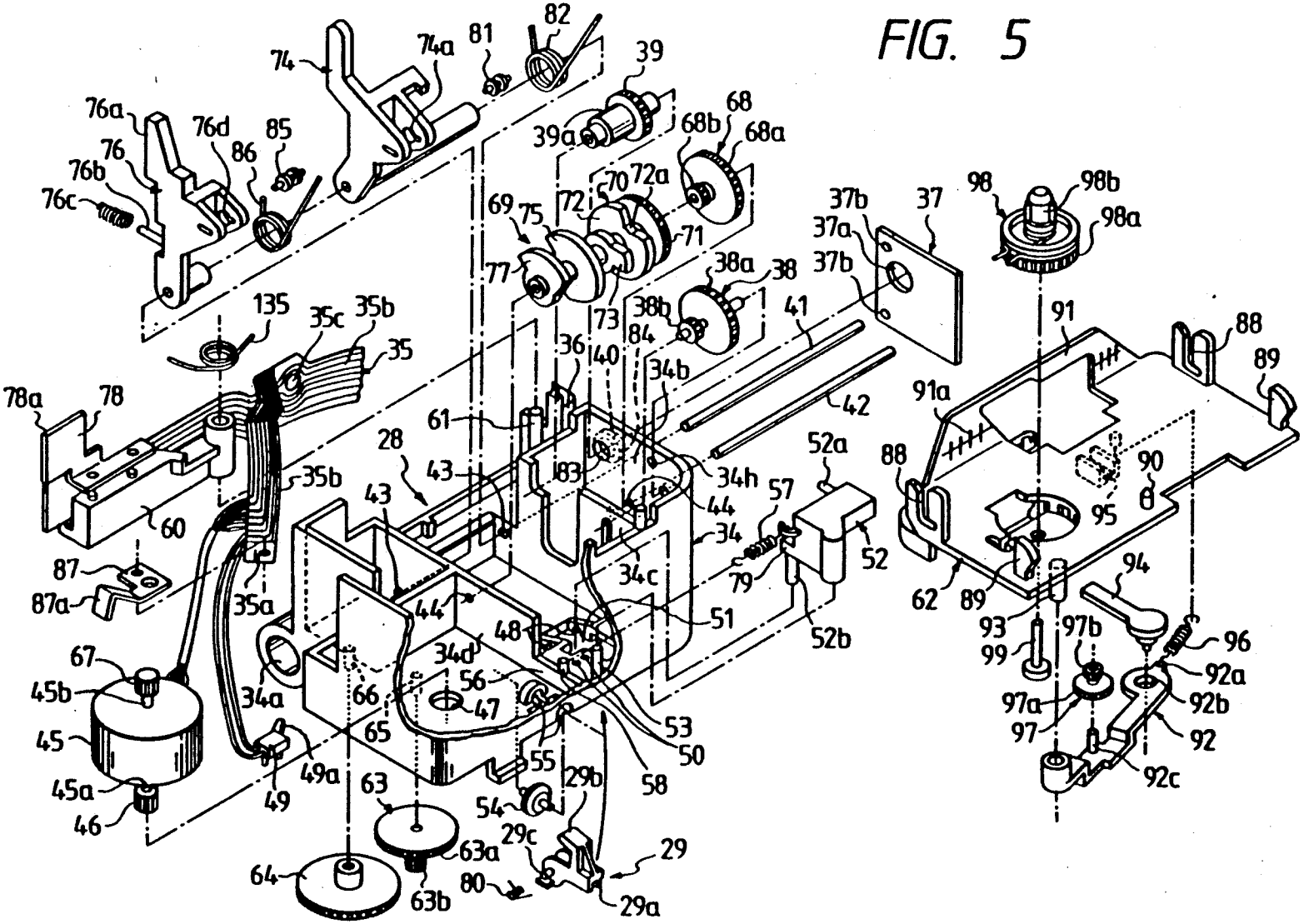
FIG. 5 is an exploded perspective view of the carriage in the image recording apparatus shown in FIG. 1.
Figure 7:
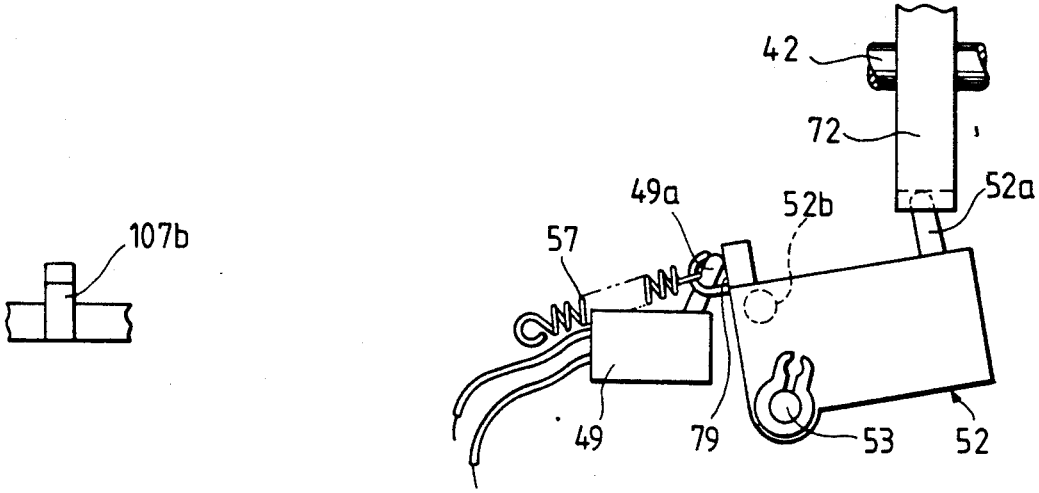
FIG. 7 is a plan view of a sensor lever and a home position sensor, both of which are shown in FIG. 5.
Figure 8:
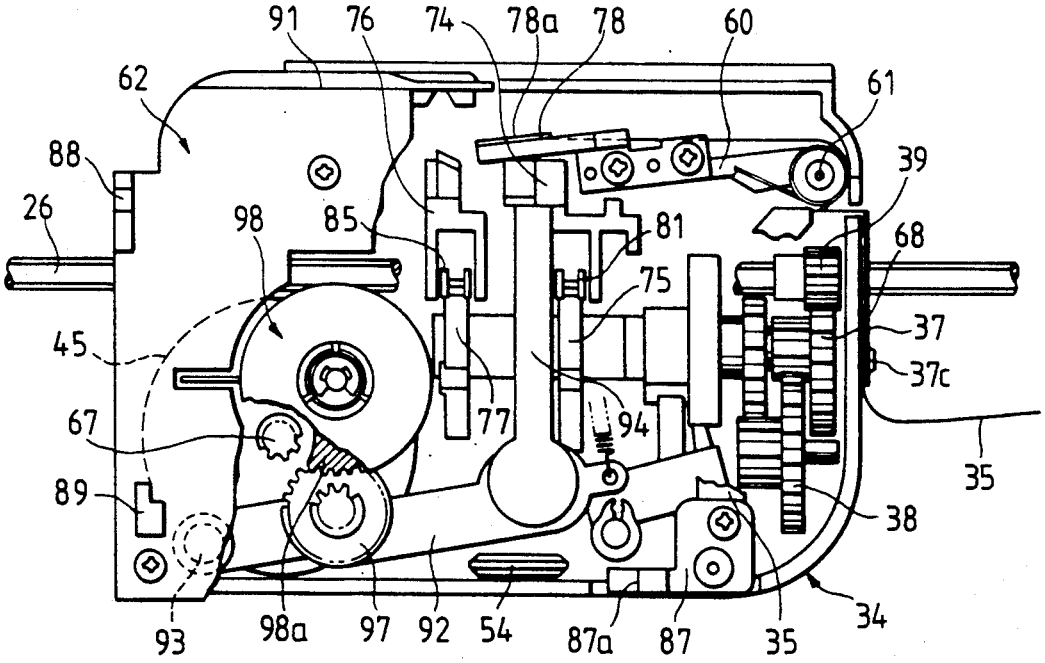
FIG. 8 is a partially cutaway plan view showing an internal structure of the carriage shown in FIG. 5.

Referring to FIG. 5, two bearings 34*a* for supporting the carriage shaft 32 are mounted in a frame 34 of the carriage 28. The right portion (e.g., a support 40) of a slide gear 39 and various holes (e.g., a hole 44) are formed in a right side plate 34*b* of the carriage frame 34. A groove 36 for supporting the flexible cable (FPC) 35 and a screw hole for fixing an FPC press member 37 are formed in the right side plate 34*b* of the carriage frame 34. For example, a hole 34*h* for supporting a two-stage reduction gear 38 is formed in the right side plate 34*b* and a wall 34*c*. The support 40 of the slide gear 39 is formed on the right side plate 34*b*. Holes 43 for supporting a lever shaft 41 are respectively formed in the wall 34*c* and a wall 34*d*. The holes 44 for supporting a cam shaft 42 are respectively formed in the right side plate 34*b* and the wall 34*d*.

A screw hole (not shown) for fixing the carriage motor 45, a hole 47 for receiving a pinion 46 mounted on a lower shaft 45*a* of the carriage motor 45, holes 48 for supporting the clutch rack lever 29, holes 50 for fixing a home position sensor 49, and an opening 51 for receiving the clutch rack lever 29 such that it extends downward are formed in the bottom plate of the frame 34 of the carriage 28. A rotating shaft 53 of a sensor lever 52 is mounted on the bottom plate of the frame 34. A hole 55 for supporting the carriage roller 54 is also formed in the bottom plate of the frame 34. A rib 56 for preventing short-circuiting of lead wires of the home position sensor 49, a hook portion 58 of a return spring 57 of the sensor lever 52, and a rotating shaft 61 of a head arm 60 are further formed and arranged on the bottom plate of the frame 34. Screw holes (not shown) for mounting a carriage cover 62 are formed at the four corners of the upper surface of the frame 34 of the carriage 28. Shafts 65 and 66 are formed on the lower surface of the frame 34 to support a carriage gear 63 and the carriage idler gear 64. The carriage roller 54 is arranged to reduce the load of the carriage 28 during its movement and is in rolling contact with the upper surface of the guide rail 107*d*.

The carriage motor 45 comprises a biaxial motor, so that an upper pinion 67 in addition to the lower pinion 46 is arranged in the carriage motor 45.

The carriage gear 63 is a two-stage gear. A large-diameter gear 63*a* of the carriage gear 63 is meshed with the pinion 46 of the carriage motor 45. A small-diameter portion 63*b* of the carriage gear 63 is meshed with the carriage idler gear 64. The carriage idler gear 64 is also meshed with the carriage rack 107*c* arranged on the base 1.

Upon rotation of the carriage motor 45, the carriage 28 is moved. The moving direction of the carriage 28 is determined by the rotational direction of the carriage motor 45. Note that the carriage is moved in the forward direction upon clockwise rotation of the motor 45 and in the reverse direction upon counterclockwise rotation.

The boss 39*a* of the slide gear 39 is rotatably supported by the frame 34. The torque shaft (having a heterogeneous cross section) 26 is fitted in a hole (having an identical heterogeneous cross section) of the slide gear 39. Therefore, the slide gear 39 is rotated together with the torque shaft 26. The slide gear 39 is meshed with a large-diameter gear 68*a* of a two-stage gear 68. The slide gear 39 and a cam II 70 are supported by the cam shaft 42. The reduction gear 38 also comprises a two-stage gear. A large-diameter gear 38*a* of the reduction gear 38 is meshed with a small-diameter gear 68*b* of the intermediate gear 68. A gear 71 which is meshed with a small-diameter gear 38*b* of the reduction gear 38, a sensor cam 72 which is in contact with a distal end portion 52*a* of the sensor lever 52, and a clutch cam 73 which is in contact with the clutch rack lever 29 are formed integrally with the cam II 70.

A cam I 69 integrally comprises a head cam 75 which is in contact with a head lever 74 and a delay cam 77 which is in contact with a delay lever 76. An fitting portion of the cam I 69 is engaged with a fitting portion of the cam II 70 so that these cams are rotated together.

The head lever 74 is arranged to push the thermal head 78 on the head arm 60.

The delay lever 76 is used to delay a separation timing of a thermal transfer recording ink sheet. More specifically, the delay lever 76 delays the time required until an ink sheet 115 is separated from the recording sheet 212 upon heating of the thermal head 78. In the operative position (i.e., the down position), the delay lever 76 urges the ink sheet 115 against the recording sheet 212.

In addition to the distal end portion 52*a* which is in contact with the sensor cam 72, a projection 52*b* which extends downward to abut against the left limiter detection boss 107*b* (FIG. 1) and a sensor press portion 79 which is in contact with the home position sensor 49 are formed on the sensor lever 52. The sensor lever 52 is rotatably supported by a rotating shaft 53, while the sensor press portion 79 is biased in a direction to be brought into contact with the home position sensor 49.

The home position sensor 49 serves as a cam sensor for detecting stand-by positions of the cams I 69 and II 70. The home position sensor 49 also serves as a left limiter for detecting that the carriage 28 has reached the left end position.

The clutch rack lever 29 comprises the teeth 29*a* which can be meshed with the clutch rack 27 arranged to be slid along the base 1, a distal end portion 29*b* which is in contact with the clutch cam 73, and a shaft 29*c* supported by the frame 34. The clutch rack lever 29 is biased by a spring 80 such that the distal end portion 29*b* of the lever 29 is brought into contact with the clutch cam 73.

The head lever 74 is rotatably supported by a lever shaft 41 inserted into the through holes 43 of the frame 34. A cam roller 81 is urged by an end of a head spring 82 and is supported in an elongated hole 74*a* formed in the head lever 74. The head cam 75 is in contact with the head lever 74 through the cam roller 81.

In the head-down state, the distal end of the head lever 74 urges the thermal head 78 on the head arm 60 against the platen 7 by the spring force of the head spring 82.

The head arm 60 is pivotal about the shaft 61 arranged on the frame 34 in a direction (i.e., a vertical direction in FIG. 5) perpendicular to the platen 7. Note that removal of the head arm 60 from the shaft 61 can be prevented by the carriage cover 62.

The signal transmission flexible cable (FPC) 35 extending from the recording head (thermal head) 78 passes through the carriage 28 and is merged to a portion connected to the terminals of the carriage motor 45 and the home position sensor 49. The flexible cable 35 passes through a groove 36 formed in the frame 34 of the carriage 28 and extends outside the carriage 28. The flexible cable 35 is finally positioned at the frame 34 by the FPC press member 37.

Figure 6:
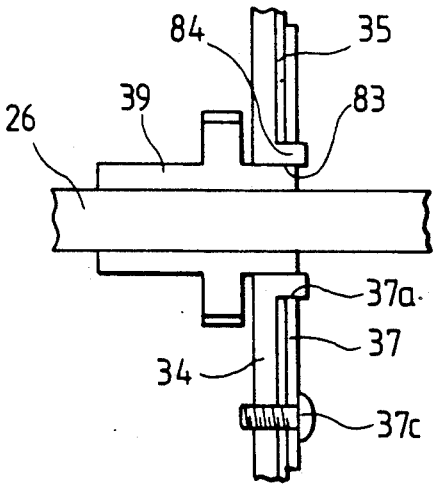
FIG. 6 is a partial sectional view of an FPC press member mounting portion in FIG. 5.

In this case, as shown in FIG. 6, a projection 84 is formed around a through hole 83 formed in the frame 34 to receive the torque shaft 26 for transmitting a drive force to the carriage 28. The projection 84 is fitted in an opening 35*c* formed in the flexible cable 35 and an opening 37*a* formed in the plate-like FPC press member 37. The FPC press member 37 is fixed to the frame 34 by a screw 37*c*. Therefore, the FPC 35 is located at a predetermined position of the carriage frame 34 such that the FPC 35 is kept separated from the torque shaft 26.

When the flexible cable (FPC) press member 37 is fixed, removal of the lever shaft 41 and the cam shaft 42 which are inserted into the through holes 43 and 44 of the frame 34 is also prevented. A screw hole 37*b* is used to mount the FPC press member 37 to the frame 34 by the screw 37*c*.

One end of a head return spring 135 is engaged with the head arm 60 around the rotating shaft 61 of the head arm 60. The other end of the spring 135 is engaged with the carriage frame 34.

The delay lever 76 is coaxial with the head lever 74 and rotatably supported by the lever shaft 41.

A cam roller 85 is urged by the distal end portion of a delay spring 86 and is urged into an elongated hole formed in the delay lever 76. The delay cam 77 is in contact with the delay lever 76 through the cam roller 85.

In the head-down state, a distal end portion 76*a* of the delay lever 76 urges the ink sheet 115 and the recording sheet 212 against the platen 7 by the spring force of the delay spring 86. In the head-up state (i.e., in a state except for the head-down state), the delay lever 76 is kept in contact with the delay cam 77 by a biasing force of a compression spring 76c mounted in a spring guide portion 76b of the delay lever 76.

A conductive member 87 discharges the ink sheet 115. The conductive member 87 is positioned by a hole of the conductive member and the shaft on the frame 34. There is employed a ground connection mechanism wherein a conductive portion 35a exposed at one end of the flexible cable 35 and the conductive member 87 overlap and are screwed on the frame 34. The conductive member 87 is used to ground and discharge the ink sheet 115. The conductive member 115 has a shape which extends upward from the carriage cover 62. A distal end portion 87a of the conductive member 87 is in contact with a ground plate 116 within the ink sheet cassette 33. The ground plate 116 is in contact with the ink sheet 115 within the cassette.

The carriage cover 62 constitutes a cassette loading portion for detachably loading an ink sheet (ink ribbon) cassette 33. The carriage cover 62 has guide grooves 88 for guiding the cassette 33. Pawls 89 are formed on the carriage cover 62 to prevent cassette 33 from being removed from the guide hole.

Pins 90 also extend on the cover 62 to perform positioning of the cassette 33 in the right-and-left direction. A recording sheet regulating plate 91 is formed integrally with the front end of the carriage cover 62 to regulate positions of the recording sheet 212 on the platen 7 and the ink sheet 115. This regulating plate 91 serves as a guide plate for guiding the recording sheet 212 and the ink sheet 115 along the platen 7 and is made of a transparent plastic molded body. The regulating plate 91 is the same transparent plastic material as the carriage cover 62 and is formed integrally therewith. The carriage cover 62 may be opaque and only the regulating plate 91 may be transparent.

A scale 91a for indicating a position of the recording head 78 with respect to the recording sheet 212 is formed on the recording sheet regulating plate 91. When the recording sheet regulating plate 91 is formed integrally with the carriage cover 62, the number of components and the number of manufacturing steps can be reduced, resulting in low cost. A self correction ink ribbon cassette, a two-color ribbon ink ribbon cassette or a normal monochromatic printing ink ribbon cassette can be loaded on the upper surface of the carriage cover 62.

A ribbon lever 92 is rotatably supported by a shaft 93 extending downward from the carriage cover 62. A spring hook 92a, a slide hole 92b, and a ribbon gear shaft 92c are formed/arranged on the lever 92. A ribbon head slider 94 is slidably held in the slide hole 92b of the ribbon lever 92 and is guided by a guide 95 of the carriage cover 62.

A spring 96 always biases the ribbon lever 92 toward the platen 7. A two-stage gear type ribbon gear 97 is supported on a ribbon gear shaft 92c of the ribbon lever 92. The ribbon gear 97 is a two-stage gear which can be meshed with the upper pinion 67 of the carriage motor 45 and a ribbon clutch 98. Since the gear 97 is supported on the ribbon lever 92, the ribbon gear 97 is disengaged from the pinion 67 and the ribbon clutch 98 upon pivotal movement of the ribbon lever 92. In the head-up state wherein the head lever 74 is moved toward the front side, the distal end portion of the ribbon head slider 94 which is pivoted together with the ribbon lever 92 is urged by the head lever 74. For this reason, rotation of the carriage motor 45 to separate the ribbon gear 97 from the pinion 67 and the ribbon clutch 98 (its large-diameter gear 98a) is not transmitted to the ribbon clutch 98.

In the head-down state, the ribbon head slider 94 and the ribbon lever 92 are pivoted counterclockwise upon movement of the head lever 74. A large-diameter gear 97a and a small-diameter gear 97b of the ribbon gear 97 are meshed with the pinion 67 and the large-diameter gear 98a of the ribbon clutch 98, so that the ink sheet 115 is taken up in synchronism with movement of the carriage 28 upon rotation of the carriage motor 45.

The ribbon clutch 98 constitutes a ribbon take-up drive force receiving portion having an excessive torque release function and comprises a frictional clutch. The ribbon clutch 98 is rotatable about a shaft 99 fixed to the carriage cover 62 by compressive insertion. The lower gear 98a of the ribbon clutch 98 is meshed with the small-diameter gear 97b of the ribbon gear 97. The ribbon clutch 98 therefore transmits a power to a ribbon cassette take-up spool with a predetermined frictional force.

In this embodiment, a pivot center 93 of the ribbon lever 92 is selected to be a predetermined position offset from that of the ribbon clutch shaft 99. When the ribbon drive force is switched from the OFF state to the ON state, the large-diameter gear 97a of the ribbon gear (drive force transmitting member) 97 is engaged with the pinion (drive force supply side) 67 of the carriage motor 45, and then the small-diameter gear 97b of the ribbon gear 97 is engaged with the gear (drive force receiving side) 98a of the ribbon clutch 98. In this embodiment, since the drive force supply side is subjected to engagement prior to the drive force receiving side, dummy take-up of the ink ribbon (ink sheet) can be prevented, and therefore the ink ribbon take-up operation can be performed with high reliability.

Figure 9:
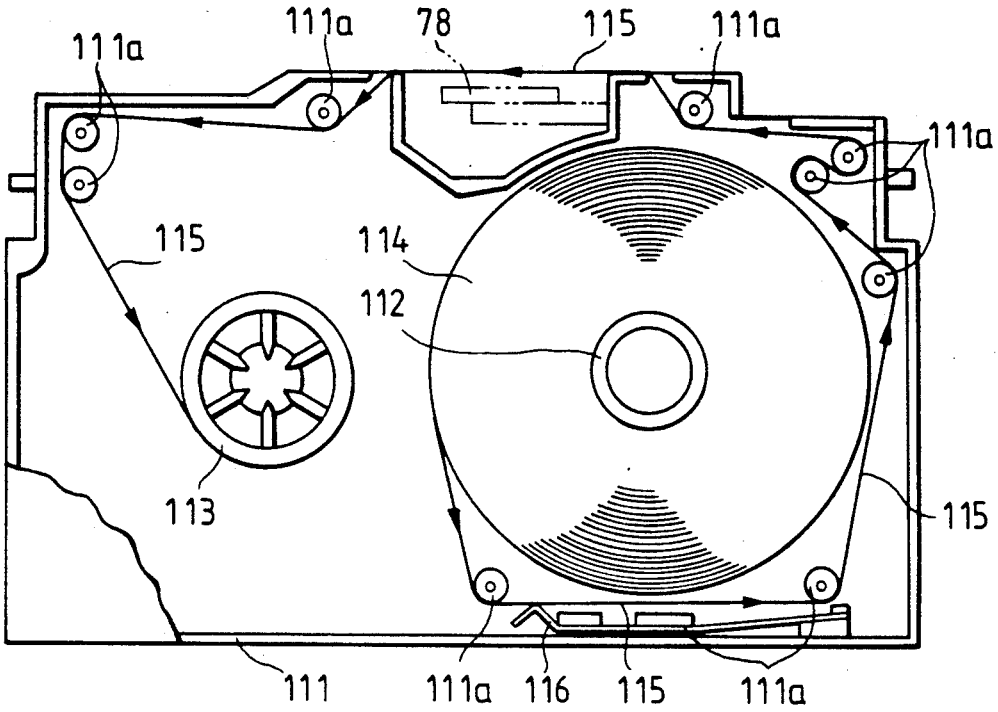
FIG. 9 is a partially cutaway plan view showing an interior of an ink ribbon cassette loaded on a carriage cover.
Figure 10:
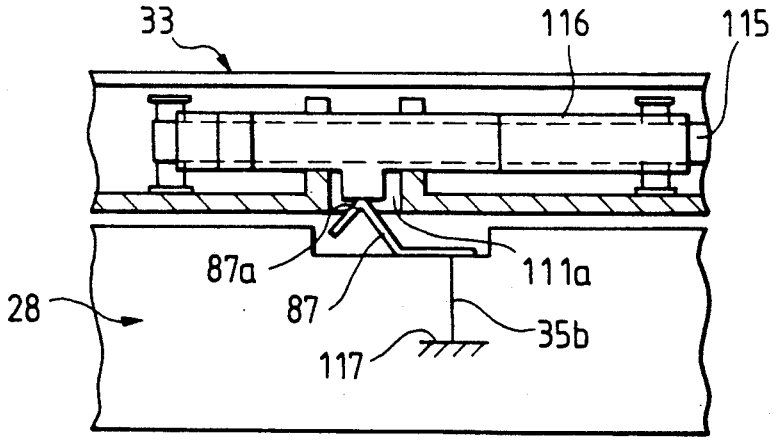
FIG. 10 is a partially longitudinal sectional view showing a ribbon grounding means of an ink ribbon cassette.

As shown in FIG. 9, a supply core 112 and a take-up core 113 are rotatably arranged within a cassette case 111 of the ink ribbon cassette 33. The take-up core 113 is rotated by a take-up spool (ribbon drive shaft) 98b (FIG. 5) of the ribbon clutch 98 on the carriage 28. A roller 111a is used to guide the ink ribbon 115.

The ink ribbon (ink sheet) 115 is guided from a ribbon pancake 114 on a supply core 112 in a direction of an arrow. The ink ribbon is then taken up on the take-up core 113 while the ribbon is being supplied along the front surface of the recording head 78. The conductive ground plate 116 which is in contact with the ink ribbon 115 and the distal end portion 87a of the conductive member 87 on the carriage through a bottom opening 111a is mounted within the cassette case 111. As described above, the conductive member 87 overlaps and is screwed together with the the exposed conductive portion 35a at the end of the flexible cable 35.

A ground wire 35b, one end of which is connected to the conductive portion 35a, is sealed in the flexible cable 35. The ground wire 35b is grounded with the ground circuit on the board 117 to which the other end of the flexible cable 35 is connected.

By electrically connecting the flexible cable 35 to the conductive and discharge members 87 and 116, the charge of the ink sheet in the ink ribbon cassette 33 is removed to the board 117 through the flexible cable 35. Therefore, there is provided a compact charge preventing apparatus for an ink ribbon (ink sheet), wherein discharge can be performed without disturbing reciprocal movement of the carriage, the number of components is small, and an installation space can be minimized.

A release mechanism in the recording sheet convey apparatus will be described below.

Referring to FIGS. 2 and 4, the release lever 16 is rotatably supported by the shaft 3*a* of the paper feed (PF) roller 3 and comprises the lever portion (knob) 16*a* which can be manually operated by an operator and the gear 16*b* meshed with a gear portion 120*a* of the release shaft 120. Upon manual rotation of the lever portion 16*a* in a direction of arrow A, the pinch rollers 8 and the front rollers 9 are separated from the PR rollers 3, so that the recording sheet 212 can be freely moved.

The release shaft 120 comprises the gear portion 120*a* and a shaft portion 120*b*. The shaft portion 120*b* is rotatably supported by the base 1 of the recording apparatus.

A part of the shaft portion 120*b* which is not brought into contact with the pinch roller 8 and the front roller 9 has a circular cross section. However, parts of the shaft portion 120*b* which are brought into contact with the pinch rollers 8 and the front rollers 9 have a cam shape, two circumferential surface portions of which are chamfered surfaces, as shown in FIG. 2.

As shown in FIG. 2, the arm 10 for supporting the shaft of the pinch roller 8 and the front roller 9 is urged against the surface of the PF roller 3 by the pinch spring 11. The pinch roller rubber member 5 of the pinch roller 8 and a feed roller 9*a* keep the recording sheet 212 on the PF roller 3 in a tightly contact state.

Upon pivotal movement of the release lever 16 in the direction of arrow A, meshing between the gears 16*b* and 120*a* causes rotation of the release shaft 120. The pinch spring 11 is released from the pinch roller 8 and the support arm 10 by the behavior of the cam surface of the release shaft 120. The outer surfaces of the pinch roller 8 and the front roller 9 are separated from the outer surface of the PF roller 3, so that the recording sheet 212 can be freely moved with respect to the PF roller 3. Therefore, the recording sheet 212 can be freely inserted or removed.

Figure 11:
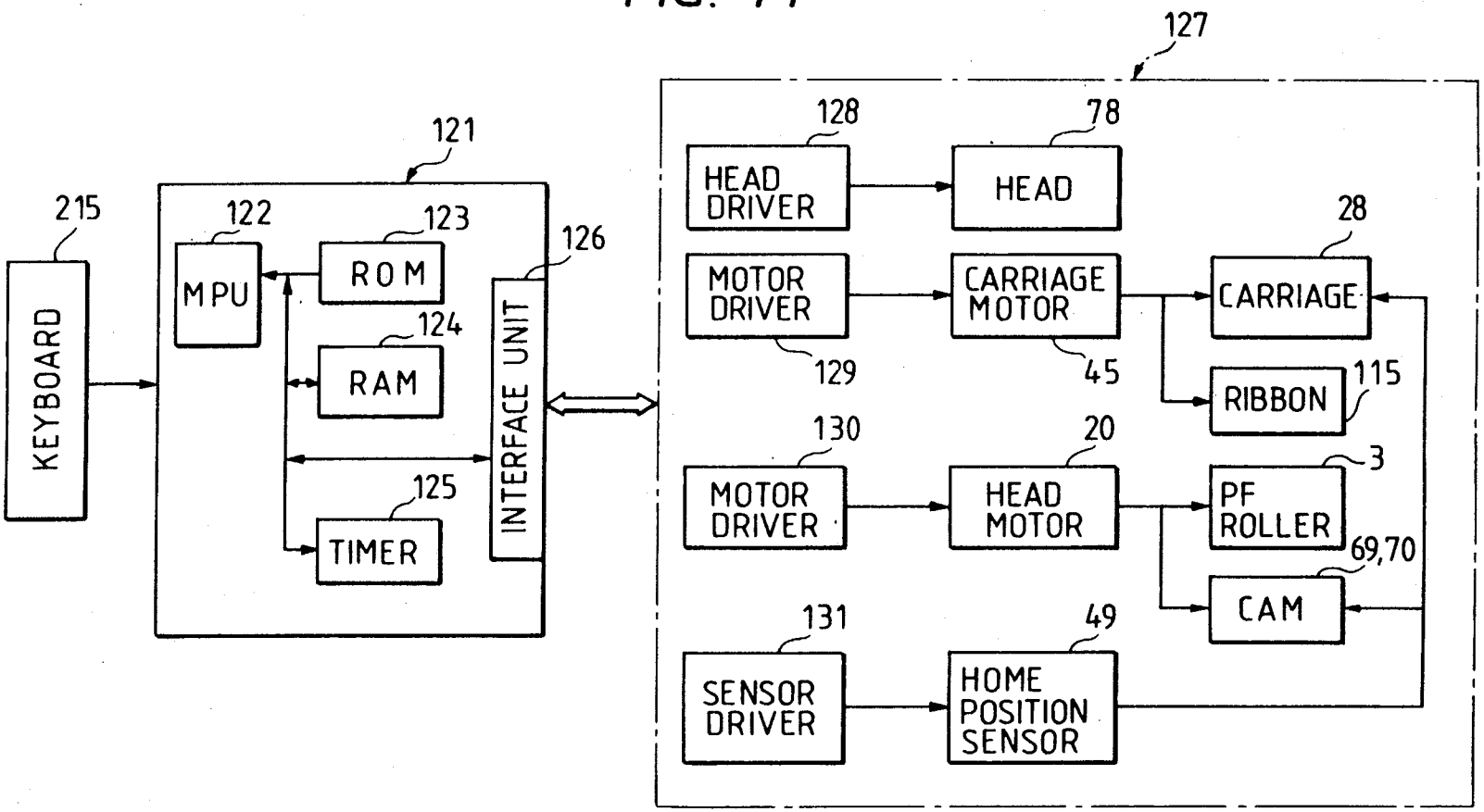
FIG. 11 is a block diagram of a control system in the image recording apparatus shown in FIG. 1.

FIG. 11 is a block diagram showing a control system of the recording apparatus of this embodiment.

Referring to FIG. 11, the control system includes a control unit 121 for controlling the overall operation of the recording apparatus such as a printer or a typewriter. The control unit 121 includes an MPU (microprocessor) 122 for outputting various control signals in accordance with control programs and performs the overall control of the recording apparatus, a ROM 123 for storing necessary permanent data such as the control programs, a RAM 124 used as a working area of the MPU 122, a timer 125 for counting time on the basis of the instruction signals from the MPU 122 and outputting time information, and an interface unit 126 for performing inputs/outputs of time data.

The control unit 121 controls a recording unit 127 in accordance with inputs from the keyboard 215.

The recording unit 127 comprises a printing mechanism for heating the thermal head 78 (the head has a plurality of heating elements 78*a*) through a head driver 128, a carriage moving mechanism for driving the carriage motor 45 to move the carriage 28 through a motor driver 129, a ribbon take-up mechanism for taking up the ink sheet (ink ribbon) by utilizing the motor driver 129 and the carriage motor 45, and a cam mechanism for driving the head motor 20 through another motor driver 130 to rotate cams I 69 and II 70 so as to perform the up/down operations of the head 78 and the delay lever 76, engagement/disengagement of the clutch rack lever 29. The recording unit 127 further includes a convey mechanism for controlling rotation of the paper feed (PF) rollers 3 by using the head motor 20 and the switching means such as the selection gear 22, thereby performing conveyance (feeding) of the recording sheet 212, and a sensor mechanism for controlling the carriage 28 and the cams I 69 and II 70 in accordance with ON/OFF signals from the home position sensor 49 through a sensor driver 131.

The following mechanism is arranged to detect whether the angular positions of the cams I 69 and II 70 are stand-by positions, i.e., the head 78, the delay lever 76, the clutch rack lever 29, and the like are kept at the stand-by positions.

The sensor lever 52 is arranged near the cams I 69 and II 70 on the carriage 28 so as to be pivotal about the shaft 53. The sensor lever 52 is biased such that the distal end portion 52*a* of the lever 52 is brought into tight contact with the sensor cam 72 by the return spring 57 kept taut between the sensor lever 52 and the carriage 28. The projection 52*b* is formed on the lower surface of the sensor lever 52 to extend downward. When the carriage 28 comes to the left end position, the projection 52*b* abuts against the boss 107*b* on the base 1 to pivot the sensor lever 52. Pivotal movement of the sensor lever 52 is detected by the home position sensor 49. With the above mechanism, when the cams I 69 and II 70 are rotated to the stand-by positions, the recess 72*a* comes to the position of tight contact between the sensor cam 72 and the distal end portion 52*a* of the sensor lever 52. The sensor lever 52 is pivoted by the biasing force of the spring 57. In this state, the press portion 79 of the sensor lever 52 urges an actuator 49*a* of the home position sensor 49. The home position sensor 49 is turned on.

When the cams I 69 and II 70 are rotated from the stand-by positions in a forward direction (i.e., the X direction in FIGS. 12A to 12D) or a reverse direction (i.e., the Y direction in FIGS. 12A to 12D), the distal end portion 52*a* of the sensor lever 52 is disengaged from the recess 72*a*. The sensor lever 52 is rotated against the spring 57, and its press portion 79 is disengaged from the actuator 49*a*. Therefore, the home position sensor 49 is turned off.

In this embodiment, whether the cams I 69 and II 70 are located at the stand-by positions, i.e., whether the head 78, the delay lever 76, and the clutch rack 27 are located at the stand-by positions is detected to determine whether the home position sensor 49 comprising a microswitch is ON/OFF.

In this embodiment, the home position (normally, the left end position) can be detected through the home position sensor 49. For this purpose, the boss 107*b* is formed on the base of the recording apparatus at the position corresponding to the home position of the carriage 29.

That is, when the carriage 29 is kept moved to the left, the boss 107*b* abuts against the downward projection 52*b* on the sensor lever 52. The home position sensor 49 comprising the microswitch is turned off, thereby detecting the home position of the carriage 28.

The home position sensor 49 and the sensor lever 52 which ON/OFF-controls the home position sensor 49 serve as a reference position left limiter and a cam sensor for detecting the stand-by positions of the cams I 69 and II 70. In this manner, initialization control (initial position setting) of the respective active components upon power-on of the recording apparatus can be performed by one home position sensor 49.

When the cams I 69 and II 70 are set at the stand-by positions (i.e., the home position sensor 49 is ON) in advance, and when the carriage 29 is moved to the left and reaches the left end, the boss 107*b* abuts against the downward projection 52*b*. The sensor lever 52 is then pivoted against the biasing force of the return spring 57, and the distal end portion 52*a* of the sensor lever 52 is disengaged from the recess 72*a* of the sensor cam 72. The press portion 79 of the sensor lever 52 is separated from the actuator 49*a*. Therefore, the home position sensor 49 is turned off, and the home position of the carriage 28 is detected.

During this switching, when the carriage 28 is moved to the left by a small distance (e.g., 0.4 to 0.6 mm), the carriage motor 45 is stopped. In this embodiment, after the carriage motor 45 is stopped, the carriage 28 is moved to the right by a predetermined distance. The projection 52*b* of the sensor lever 52 is disengaged from the boss 107*b* on the base 1. This position of the carriage 28 is set to be its home position.

The up/down operations of the head 78 and the delay lever 76 of the image recording apparatus (e.g., a printer or a typewriter) will be described below.

When the cams I 69 and II 70 are located at the stand-by positions, and then the head motor 20 is rotated in the forward direction, the selection gear 22 meshed with the motor pinion 21 is also rotated. The rotational force is transmitted to the torque shaft gear 25 through the intermediate gears I 13 and II 24, thereby rotating the torque shaft 26. The torque shaft 26 is a shaft having an elliptical (heterogeneous shape) cross section and extending through the carriage 28. The rotational force of the torque shaft 26 is transmitted to the carriage 28.

The slide gear 39 slidably fitted on the torque shaft 26 is rotated upon rotation of the torque shaft 26. This rotational force is transmitted to the gear 71 rotated together with the cam II 70 through the two-stage intermediate gear 68 and the two-stage reduction gear 38. The cam I 69 is rotated together with the cam II 70.

In the normal state, when the head motor 20 is rotated in the forward direction, the cams I 69 and II 70 are rotated together.

When the cams I 69 and II 70 are rotated from the stand-by positions, the sensor lever 52 which is in contact with the sensor cam 72 is moved upward along the cam surface and disables the home position sensor 49 which has been in contact with the sensor lever 52 midway along the ascending surface. Therefore, movement of the cams I 69 and II 70 from the stand-by positions is detected. When the cams 69 and 70 are further rotated in the forward direction, the cam roller 81 which is in contact with the head cam 75 is moved upward. The head lever 74 is pivoted about the lever shaft 41 parallel to the platen 7. From the rear side, the cam roller 81 urges the head 78 on the head arm 60 pivotal about the shaft 61 perpendicular to the platen 7, so that the thermal head 78 is set in the head-down state. When the cam roller 81 almost climbs up the ascending surface of the cam to a given extent, the thermal head 78 is perfectly brought into contact (down) with the platen 7.

At this time, as the radii (ascending amounts) of the delay cam 77 and the clutch cam 73 are not almost changed, the delay lever 76 and the clutch lever 29 which are in contact therewith are not moved and are kept at the initial positions.

Figure 12A:
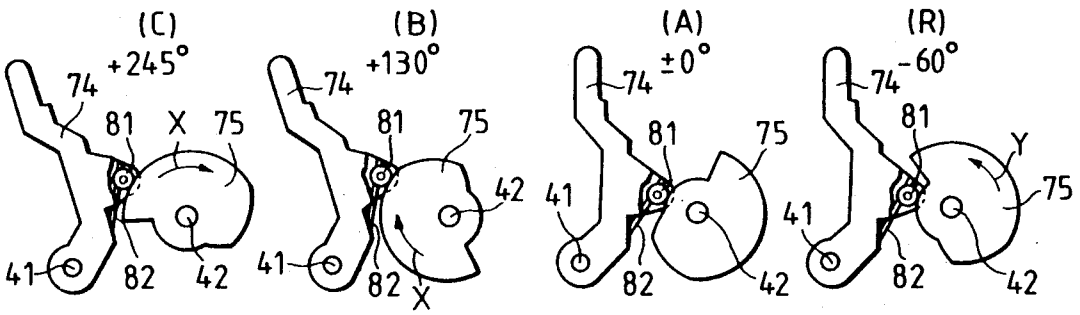
FIGS. 12A to 12D are illustrative side views showing operations of various cams in a cam mechanism shown in FIG. 1.
Figure 12B:
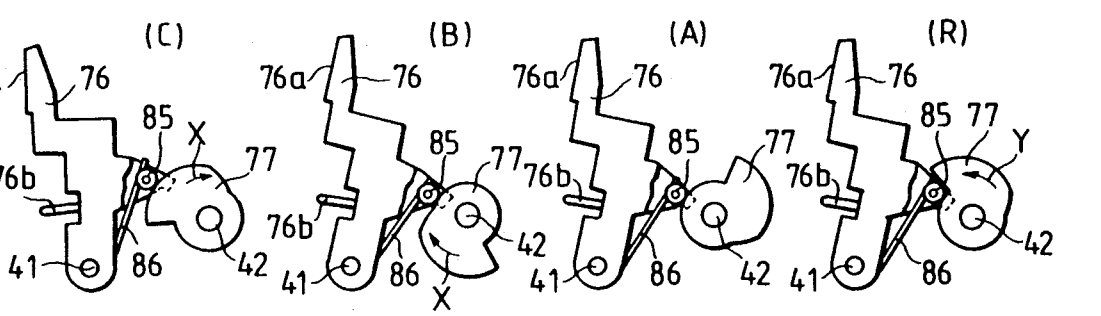
Figure 12C:
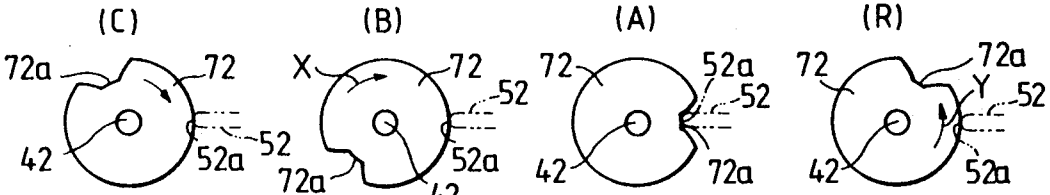
Figure 12D:
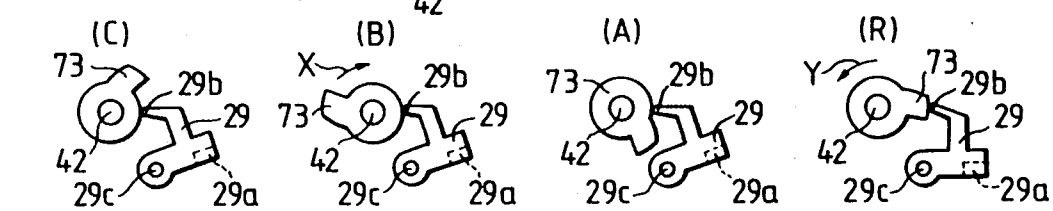

FIGS. 12A to 12D show operations of the cams I 69 and II 70. (A) in FIGS. 12A to 12D shows a state representing the stand-by position (angle: 0°), and (B) in FIGS. 12A to 12D shows a state wherein the cams I 69 and II 70 are rotated through about 130° in the forward direction (direction of arrow X) and the head lever 74 is moved downward, while the delay lever 76 is kept in the upper position. FIG. 12A shows movement of the head lever 74, FIG. 12B shows movement of the delay lever 76, FIG. 12C shows movement of the sensor lever 52, and FIG. 12D shows movement of the clutch rack lever 29.

When the cams I 69 and II 70 are further rotated in the forward direction (X direction), the cam roller 85 climbs up along the ascending surface of the delay cam 77, so that the delay lever 76 is moved downward accordingly. As indicated by (C) in FIG. 12B, when the cams I 69 and II 70 are rotated through about 245° in the forward direction, the delay lever 76 is perfectly brought into tight contact with the platen 7. At this time, the head 78 is kept in tight contact with the platen 7.

The distal end portion 76*a* of the delay lever 76 brings the ink sheet 115 into tight contact with the recording sheet 212 in the down movement, thereby delaying the time required for separating the ink sheet 115 from the recording sheet 212 upon heating of the thermal head 78.

In this embodiment, the delay lever 76 is mounted to be pivotal (up/down) about the cental line (lever shaft 41) parallel to the platen 7. The delay lever 76 can be moved in a direction almost perpendicularly to the platen 7. When the delay lever 76 is moved upward and normal printing is performed, the printed content of the recording sheet 212 can be easily confirmed (visually checked). In addition, there is provided a structure of mounting the delay lever 76 wherein the ink ribbon (ink sheet) 115 can be easily mounted on the front side of the recording head 78 and the delay lever 76.

Cam control of the head-down and the delay lever-down operations is performed upon rotation of the head motor 20 by a predetermined number of steps from the reference timing at which the home position sensor 49 is turned off for the first time upon rotation of the head motor 20. In this manner, since control is started with reference to the start of rotation of the motor 20, rotational errors caused by variations in backlash between the gears can be prevented, and accurate control can be performed.

When the up operations of the delay lever 76 and the head 78 are performed, the head motor 20 is rotated in the reverse direction from the head-down and lever-down states, thereby rotating the cams I 69 and II 70. Upon reverse rotation of the head motor 20, the operations are performed in the perfectly reverse order. More specifically, the delay lever 76 is moved upward through the cam roller 85 which is in contact with the delay cam 77 to obtain the state (B) of FIGS. 12A to 12D. The head lever 74 is then moved upward through the cam roller 81 which is in contact with the head cam 75, thereby moving the thermal head 78 upward.

Finally, the sensor lever 52 which is kept in contact with the sensor cam 72 is pivoted by the recess 52*a* to turn on the home position sensor 49, as shown in (A) of FIGS. 12A to 12D.

When the home position sensor 49 is turned on, the head motor 20 is braked and stopped within a predetermined number of steps. In this case, since rotation of the motor 20 is controlled by the sensor 49, the cams I 69 and II 70 can be stopped at stable predetermined positions having minimum positional variations.

When the motor 20 is rotated in the reverse direction from the state (B) of FIGS. 12A to 12D, i.e., the head-down state and the lever-up state, the head 78 can be moved from the down position to the up position and returns to the stand-by position in the same manner as described above.

As is apparent from the above description according to this embodiment, the head-up and the delay lever-up states are obtained in the stand-by states of the cams I 69 and II 70, i.e., the ON state of the home position sensor 49.

The lower pinion 46 of the carriage motor 45 in the carriage 28 is meshed with the rack 107*c* on the base 1 of the recording apparatus through the carriage idler gear 64 and the carriage gear 64. When the carriage motor 45 is rotated in the forward direction, the carriage 28 is moved to the right. When the carriage motor 45 is moved in the reverse direction, the carriage 28 is moved to the left.

The ribbon lever 92 supported by the carriage cover 62 is kept in contact with the head lever 74 through the ribbon lever slider 94. For this reason, when the head is moved downward, the ribbon lever 92 is pivoted, and the two-stage gear type ribbon gear 97 is inserted between the gear 98*a* of the ribbon clutch 98 and the upper pinion 67 of the carriage motor 45. Rotation of the carriage motor 45 is transmitted to the ribbon clutch 98. In this case, the pivot center (i.e., the position of the shaft 93) of the ribbon lever 92 is selected at a predetermined position away from the axis of the ribbon gear 97 or the ribbon clutch 98. The two-stage gear type ribbon gear (drive force transmission member) 97 is set at a position to come into contact with the pinion gear (the drive force supply side) 67 of the carriage motor 45 earlier than the gear 98*a* (the drive force receiving side) of the ribbon clutch 98.

When the carriage motor 45 is rotated, the gears are meshed with each other at once. Upon rotation of the carriage motor 45, the ribbon clutch 98 is properly rotated without dummy rotation or idling.

When the head 78 is moved to the up position, the ribbon gear 97 is separated from both the gear 98*a* of the ribbon clutch 98 and the pinion gear 67 of the carriage motor 45. Rotation of the carriage motor 45 is not transmitted to the ribbon clutch 98. In the head-up state, the ribbon clutch 98 is not rotated even if the carriage 28 is reciprocated. Therefore, the ribbon is not taken up.

In this embodiment, the motor (carriage motor) 45 for performing both ink sheet conveyance (i.e., ribbon take-up operation) and reciprocal movement of the carriage 28 is constituted by a biaxial motor. The drive force is transmitted through one shaft 45*a* (i.e., the pinion gear 46 fixed to the lower shaft), whereas the drive force for conveying the ink sheet is transmitted through the other shaft 45*b* (i.e., the pinion gear 67 fixed to the upper shaft).

The drive systems of the carriage 28 and the ink ribbon cassette 33 can be driven by a single motor, and a compact mechanism having a smaller number of components can be arranged.

An operation of the recording sheet convey means will be described below.

When the head motor 20 is rotated from the stand-by positions of the cam mechanisms I 69 and II 70 in the opposite direction, i.e., a direction opposite to the head-down direction, a rotational force is transmitted to the cams I 69 and II 70 in the same manner as in the head-down operation. Upon reverse rotation (the direction of arrow Y in FIGS. 12A to 12D) of the cams I 69 and II 70, the sensor lever 52 which is in contact with the sensor cam 72 is pivoted, and the home position sensor 49 is turned off in the same manner as in the head-down operation. When the cams I 69 and II 70 are further rotated, the clutch rack lever 29 which is in contact with the clutch cam 73 is pivoted to obtain a state (R) shown in FIGS. 12A to 12D. The teeth of the clutch rack lever 29 are meshed with the clutch rack 27 slidably disposed on the base 1 of the recording apparatus. Control of pivotal movement of the clutch cam 73 is performed by rotating the head motor 20 by a predetermined number of steps with reference to a timing at which the home position sensor 49 is turned on/off. In reverse rotation of the cams I 69 and II 70, the radii of the head cam 75 and the delay cam 77 are not changed. Therefore, the head lever 74 and the delay lever 76 are not moved from the stand-by positions and are kept in the up state.

The carriage motor 20 is rotated by a predetermined amount to move the carriage 28 accordingly while the clutch rack lever 29 is kept meshed with the clutch rack 27 in the carriage 28. In this case, the clutch rack 27 is also moved to the left by the predetermined amount. The selection lever 30 is pivoted about an axis 30*a* (FIG. 3) of the selection lever 30. The selection gear 22 is slid to the right (FIG. 3) against the biasing force of the spring 23. The selection gear 22 is moved from the position where it is meshed with the intermediate gear I 13 (FIG. 3A) to the position where it is meshed with the PF reduction gear 31 (FIG. 3B). Note that the selection gear 22 is kept meshed with the pinion gear 21 of the head motor 20.

In this state, when the head motor 20 is rotated, a rotational force is transmitted to the PF (paper feed) rollers 3 through the pinion gear 21 of the head motor 20, the selection gear 22, the PF (paper feed) reduction gear 31, and the PF gear 12 in the order named.

In this case, when the head motor 20 is rotated in the forward direction, the sheet 212 is fed in the reverse index direction. However, when the head motor 20 is rotated in the reverse direction, the recording sheet 212 is fed in the index direction.

After the head motor 20 is rotated by a predetermined amount, the carriage motor 45 is rotated by a predetermined amount to slightly move the carriage 28 to the right. The clutch rack 27 is also slid to the right by the same amount, and the selection lever 30 returns to the initial position. The selection gear 22 is slid to the initial position, i.e., the position where the pinion gear 21 of the head motor 20 is meshed with the intermediate gear I 13, by the spring force of the spring 23. At this moment, the PF roller 3 is disconnected from the head motor 20. The stop position of the PF roller is accurately determined by a detent spring (not shown) mounted to be engaged with the detent gear 17 mounted on the right end portion of the PF roller 3.

Rotation of the PF roller 3, i.e., a feed amount of the recording sheet 212 is finally determined by the detent mechanism even if variations in feed amount are present between the motor 20 and the PF roller 3. Therefore, the feed amount can be accurately maintained.

Finally, the head motor 20 is rotated in the forward direction until the home position sensor 49 is turned on. The motor 20 is then braked and stopped within a predetermined number of steps as in the head-up operation, thereby returning the cams I 69 and II 70 to the stand-by positions.

The clutch lever 29 returns to the stand-by position accordingly and meshing between the clutch lever 29 and the clutch rack 27 is released.

According to the above embodiment, there are provided the drive force transmission switching means (the clutch rack 27, the selection lever 30, and the selection gear 22) which can be displaceable and engageable with the carriage 28 at any position within the reciprocal range of the carriage 28 and the engaging means (the clutch cam 73 and the clutch rack lever 29) for causing the carriage 28 to engage with the drive force transmission switching means. Driving of the convey means (PF roller 3) and up/down driving of the recording head 78 by the motor 20 are switched at an arbitrary position of the carriage 28 upon movement of the carriage 28. Therefore, sheet feeding (line feed) can be performed at any position of the recording head 78. Therefore, there is provided an image recording apparatus capable of reducing the recording time by the use of one motor 20.

In the normal operation, the drive force of the motor 20 is transmitted to perform the up/down operations of the recording head 78 and the delay lever 76. In addition, since the engaging means (the clutch cam 73 and the clutch rack lever 29) is also driven in accordance with an output from the motor 20. Therefore, there is provided a compact, lightweight image recording apparatus which has a simple, accurate switching control circuit.

In the above embodiment, the sensor 49 performs both detection of the stand-by position of the cam member 75 for performing the up/down operation of the recording head 78 and detection of the home position (i.e., the position at which the boss 107*b* on the base 1 abuts against the projection 52*b* of the sensor lever 52) of the carriage 28. Therefore, initial position setting control can be achieved by one sensor 49, thereby providing a compact, low-cost image recording apparatus.

The down operation of the recording head 78 is performed by forward rotation of the cams I 69 and II 70 from their stand-by positions. A drive force is transmitted to the sheet convey means (PF rollers 3) upon reverse rotation of the cams from the stand-by positions. In addition, in order to set the initial position, the cams I 69 and II 70 are temporarily rotated in the forward direction. If no stand-by position is found, the cams I 69 and II 70 are rotated in the reverse direction. Therefore, the initial position setting operation can be performed at high speed regardless of the positions of the cams I 69 and II 70. Therefore, there is provided an image recording apparatus which has improved operational accuracy and high speed.

The initial position setting operation (initialization) upon power-on of the recording apparatus described above will be described with reference to a flow chart in FIG. 13.

Figure 13:
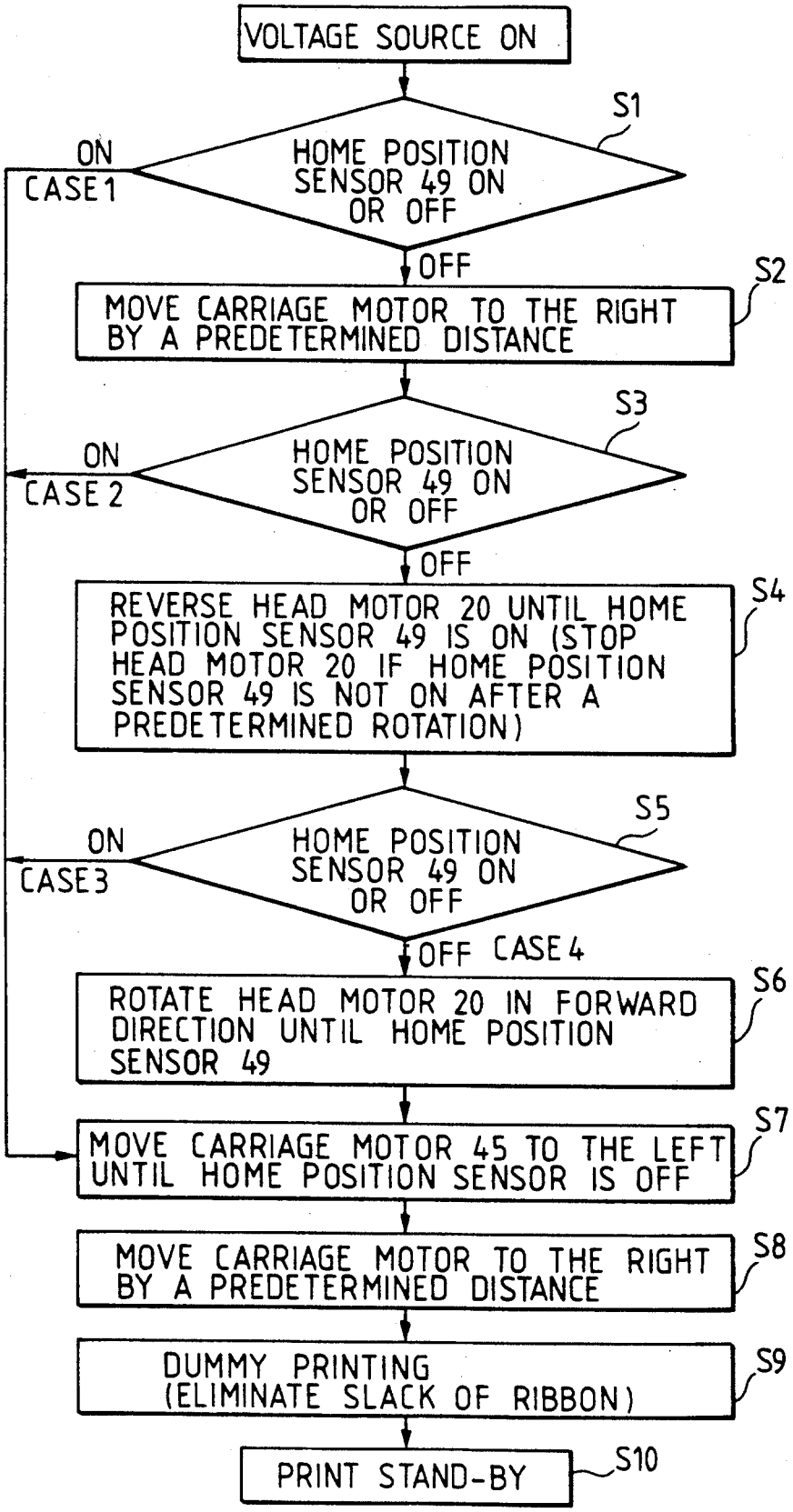
FIG. 13 is a flow chart for explaining an initial position setting operation of the image recording apparatus shown in FIG. 1.

When the voltage source is energized (ON), the flow advances to in step S1 of FIG. 13 to determine whether the home position sensor 49 is ON/OFF. If ON in step S1, i.e., if the cams I 69 and II 70 are located at the stand-by positions, and the head 78, the delay lever 76 and the clutch rack 27 are located at the stand-by positions, the flow advances to step S7.

If the cams I 69 and II 70 are not located at the stand-by positions, or when the home position sensor 49 is OFF upon abutment between the boss 107*b* on the base 1 and the projection 52*b* of the sensor lever 52, the flow advances to step S2. In step S2, the carriage motor 45 is driven to move the carriage 28 to the right by a predetermined distance. This operation is performed to locate the carriage 28 outside the operation range of the boss 107*b* of the base 1 when abutment (left limiter contact) occurs.

The ON/OFF state of the home position sensor 49 is determined again in step S3. If ON, i.e., if the same determination result as in step S1 is obtained, the flow advances to step S7. If the home position sensor 49 has been off and is turned on upon movement of the carriage 28, the flow advances to step S7.

If OFF in step S3, i.e., when the cams I 69 and II 70 are not located at the initial positions, the flow advances to step S4 to rotate the head motor 20 in the reverse direction. Until the home position sensor 49 is turned on (i.e., until the cams I 69 and II 70 reach the stand-by positions) the cams I 69 and II 70 are rotated in the reverse direction. When these cams reach their home positions, the head motor 20 is stopped.

When the the clutch lever 29 is located in a direction to move, i.e., when the lever 29 is located to convey the recording sheet, the home position sensor 49 is turned on upon reverse rotation of the cams I 69 and II 70. The flow advances to step S7 through step S5.

When the cams I 69 and II 70 are located in a direction to perform the head-down operation, the home position sensor 49 is kept off upon reverse rotation of the cams. The cams I 69 and II 70 abut again a stopper and are not rotated any longer. In this case, if the head motor 20 is rotated by a predetermined number of steps in the reverse direction and the home position sensor 49 is not turned on, the head motor 20 is stopped, and the flow advances to step S6 through step S5.

In step S6, the head motor 20 is rotated in the forward direction until the home position sensor 49 is turned on (i.e., until the cams I 69 and II 70 reach their stand-by positions). The flow then advances to step S7.

The cams I 69 and II 70 are stand-by positions in steps S4 and S6 regardless of positions of the cams I 69 and II 70. At the same time, the carriage 28 is kept outside the operation range of the boss 107*b* of the base 1 of the recording apparatus.

In step S7, the carriage 28 is moved to the left upon driving of the carriage motor 45. When the home sensor 49 is turned off, the carriage motor 45 and then the carriage 28 are stopped.

In step S8, the carriage 28 is moved to the right by a predetermined distance, so that the carriage 28 is located so as to separate the projection 52*b* of the sensor lever 52 from the boss 107*b* on the base 1.

In step S9, the head 78 is moved downward or upward to perform dummy printing by a predetermined number of characters to eliminate the slack of the ink sheet 115.

This position of the carriage 28 is detected as the initial position, i.e., the left end printing position. In step S10, the apparatus waits for the input of printing data.

With the above control, the operations shown in timing charts (FIGS. 14 to 17) representing case 1 to case 4 will be performed in accordance with the positions of the carriage 28 and the cams I 69 and II 70 upon power-on.

Figure 14:
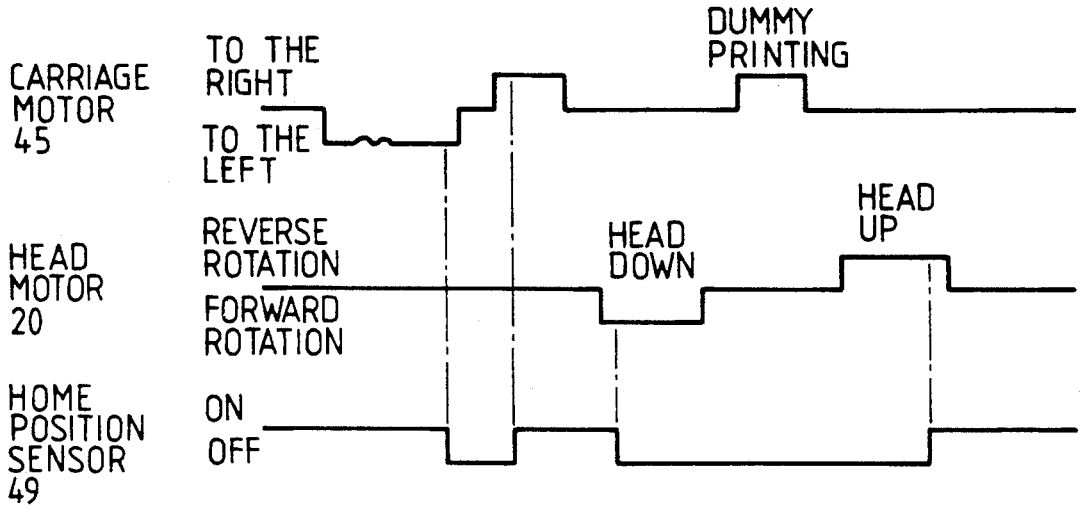
FIGS. 14 to 17 are timing charts showing various modes (case 1 to case 4) of the initial position setting operation shown in FIG. 13.

Case 1 shown in FIG. 14 is an operation wherein the carriage 28 is located so that the projection 52*b* of the sensor lever 52 is separated from the boss 107*b* on the base 1, and at the same time the cams I 69 and II 70 are located at the stand-by positions so that the home position sensor 49 is ON. Only the carriage 28 is driven by a graph of FIG. 14 in accordance with the ON/OFF state of the home position sensor. Dummy printing (head driving is not performed, and only ribbon feeding is performed) is finally performed to eliminate the slack of the ink sheet. The head-up operation is performed, and the apparatus waits for input data.

Figure 15:
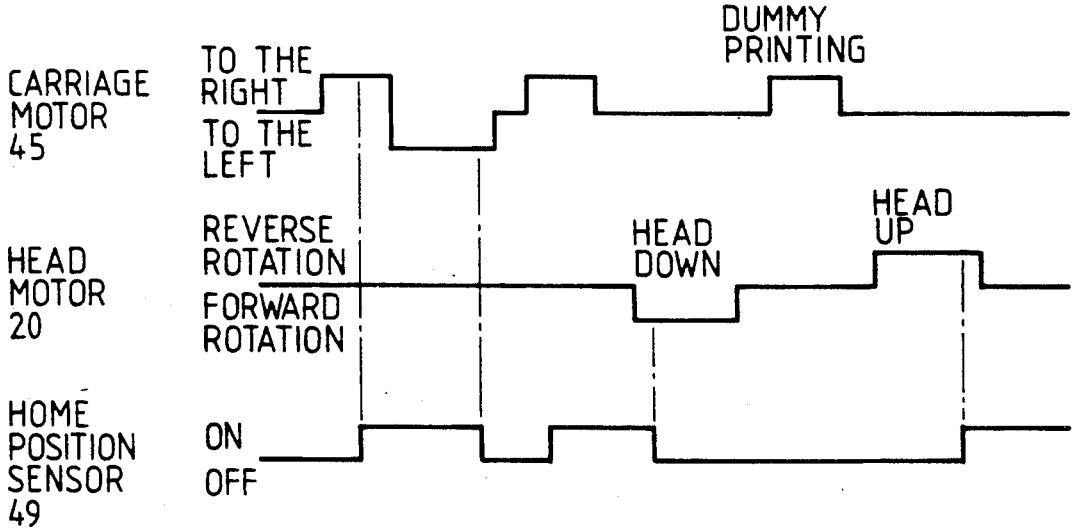

Case 2 shown in FIG. 15 is an operation wherein the carriage 28 is located at a position where the projection 52*b* of the sensor lever 52 abuts against the boss 107*b* on the base 1 of the recording apparatus, and the power switch is turned on when the cams I 69 and II 70 are located at the stand-by positions although the home position sensor 49 is kept off.

In this case, only the carriage 28 is moved as shown in the graph of FIG. 15, in accordance with the ON/-OFF operations of the home position sensor 49. Finally, dummy printing is performed to eliminate the slack of the ink sheet 115, and the head-up operation is performed. The apparatus then waits for the next data input.

Figure 16:
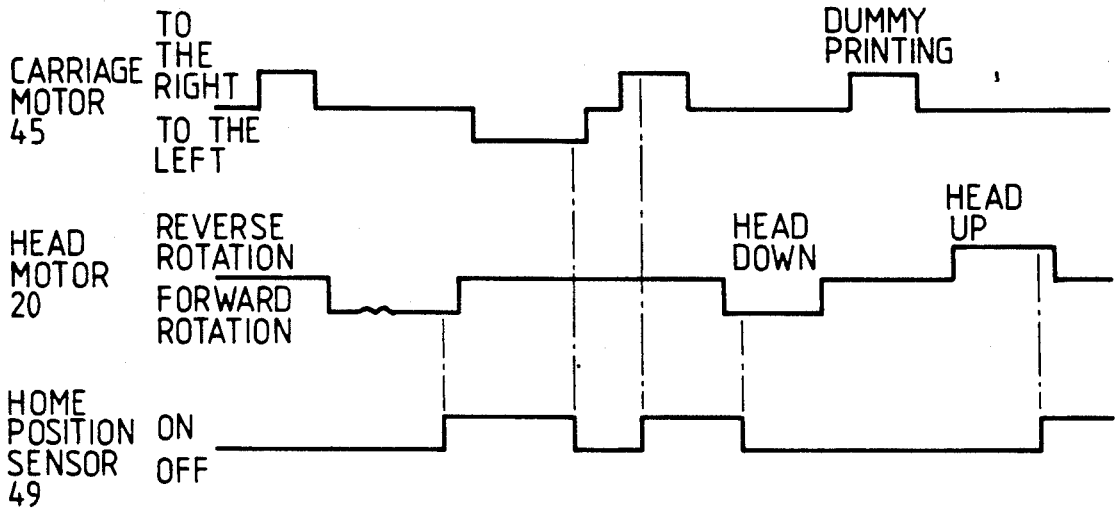
Figure 17:
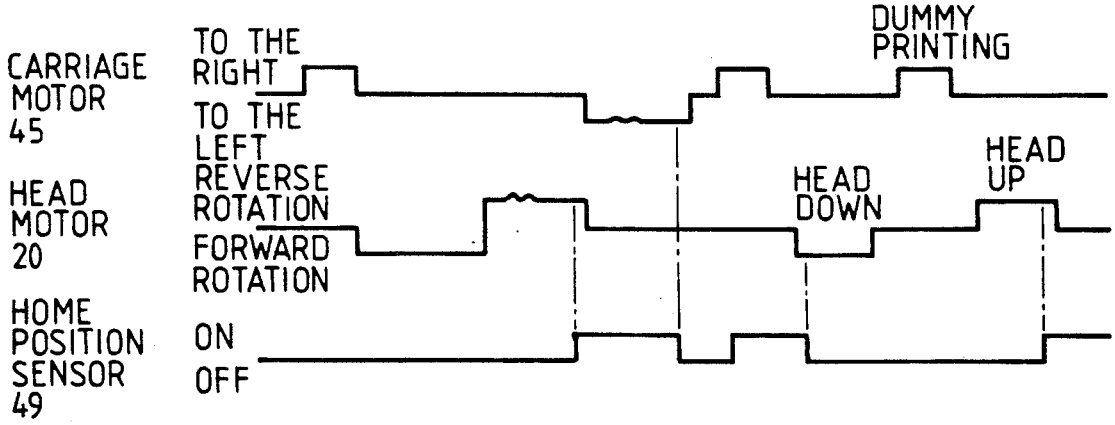

Case 3 shown in FIG. 16 and case 4 shown in FIG. 17 show operations wherein the power switch is turned on when the cams I 69 and II 70 are located at positions except for the stand-by positions and the home position sensor 49 is kept off. Case 3 in FIG. 16 shows an operation wherein the cams I 69 and II 70 are located on the side of the recording sheet convey side, i.e., on the side for driving the paper feed (PF) rollers 3, whereas case 4 in FIG. 17 shows an operation wherein the cams I 69 and II 70 are located in the head-down side.

In these cases, the carriage 28 may be located near the left end, and the projection 52*b* on the sensor lever 52 may abut against the boss 107*b* on the base 1. The carriage 28 is moved to the right by a predetermined distance. The carriage 28 and the cams I 69 and II 70 are moved, as shown in the timing charts of FIGS. 16 and 17, in accordance with the ON/OFF operations of the home position sensor 49. Finally, dummy printing is performed to eliminate the slack of the ink sheet (ink ribbon) 115. The head-up operation is performed, and the apparatus waits for the next data input.

The control operation for setting the initial positions is performed upon power-on in accordance with positions of the carriage 28 and the cams I 69 and II 70. Therefore, recording operations (printing and sheet feeding) stand-by states can be set.

When the the recording operation stand-by state is set, the position of the carriage 28 is always detected by a counter (not shown) until the power switch is turned off. The initial positions need not be detected again until the power switch is turned off.

The carriage 28 is reciprocated within the range not to interfere with the boss 107*a* on the base 1 of the recording apparatus. The home position sensor 49 is then associated with only detection of the stand-by positions of the cams I 69 and II 70 actuated by recording operations and the stand-by positions of the head 78, the delay lever 76, and the clutch rack lever 29.

A printing operation of the recording apparatus as described above will be described below.

Figure 18:
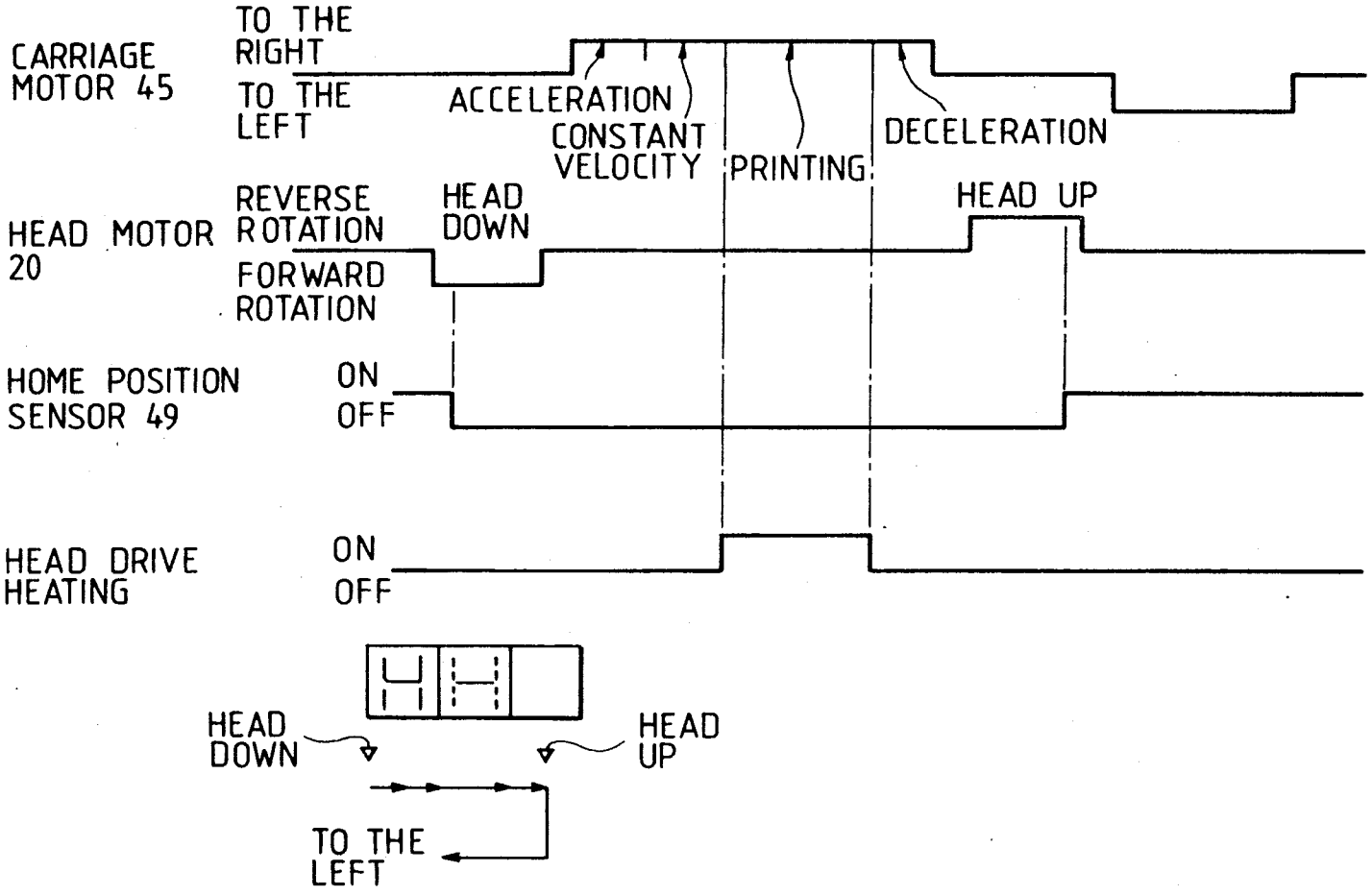
FIG. 18 is a timing chart showing a printing operation of the image recording apparatus shown in FIG. 1.

FIG. 18 is a timing chart of the printing operation.

In the printing operation, capital letters and symbols are input with the keyboard 215.

The head motor 20 is rotated in the forward direction, and a head-down operation is started when a predetermined number of steps from the OFF timing of the home position sensor 49 is counted, as described above. The carriage motor 45 is rotated to move the carriage 28 to the right. At this time, the carriage 28 is subjected to an approach run prior to printing and is accelerated. When the carriage 28 is stabilized at a constant velocity, printing (application of a voltage to the head 78) is performed.

After printing, another approach run is performed to decelerate the motor 45, and the motor 45 is finally stopped.

In this case, as described above, when the head-down operation is performed to move the carriage 28 to the right, the ink sheet 115 is taken up by the ribbon clutch 98.

The head motor 20 is then rotated in the reverse direction. When the home position sensor 49 is turned on, as described above, the motor 45 is braked and stopped. A head-up operation is then performed.

Finally, in order to prepare for the next printing cycle, the carriage 28 is moved to the left of the printing start position by a distance required for an approach run, thus completing the printing operation.

Printing of the self correction ribbon or the first layer of a so-called two-color ribbon (i.e., a ribbon described in Japanese Patent Application No. 59-260403 or 60-298831) will be described below.

The ink layers constitute a multilayered structure consisting of the first and second layers.

In this case, the ribbon cassette 33 is selected as follows. The ribbon mode can be changed upon designation of the ribbon cassette 33 at the keyboard 215. Alternatively, a ribbon mode selection switch may be arranged or a detection hole may be formed in the ribbon cassette 33, and the ribbon mode may be automatically selected in accordance with a contact formed in the carriage 28.

Figure 19A:
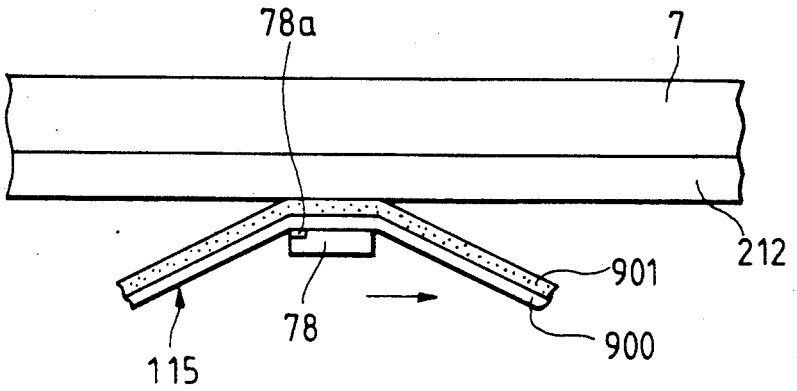
FIGS. 19A and 19B are illustrative plan views showing a normal printing state.
Figure 19B:
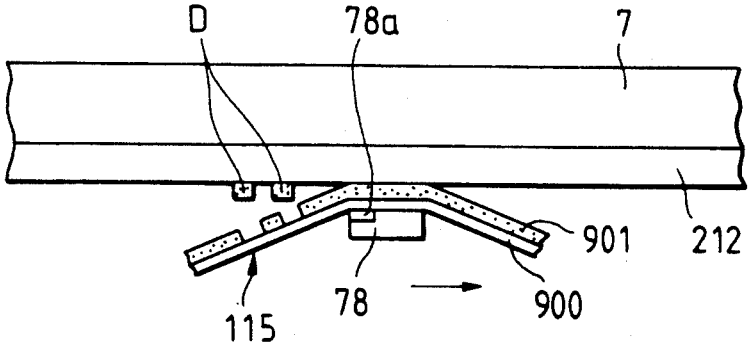

Printed states are shown in FIGS. 19A and 19B.

The ink ribbon 115 includes a substrate 900. A multilayered ink layer 901 is formed on the substrate 900. The ink layer 901 is selectively heated by the heating elements 78*b* of the head 78 and is transferred to the recording sheet 212 to form an image D.

Figure 20:
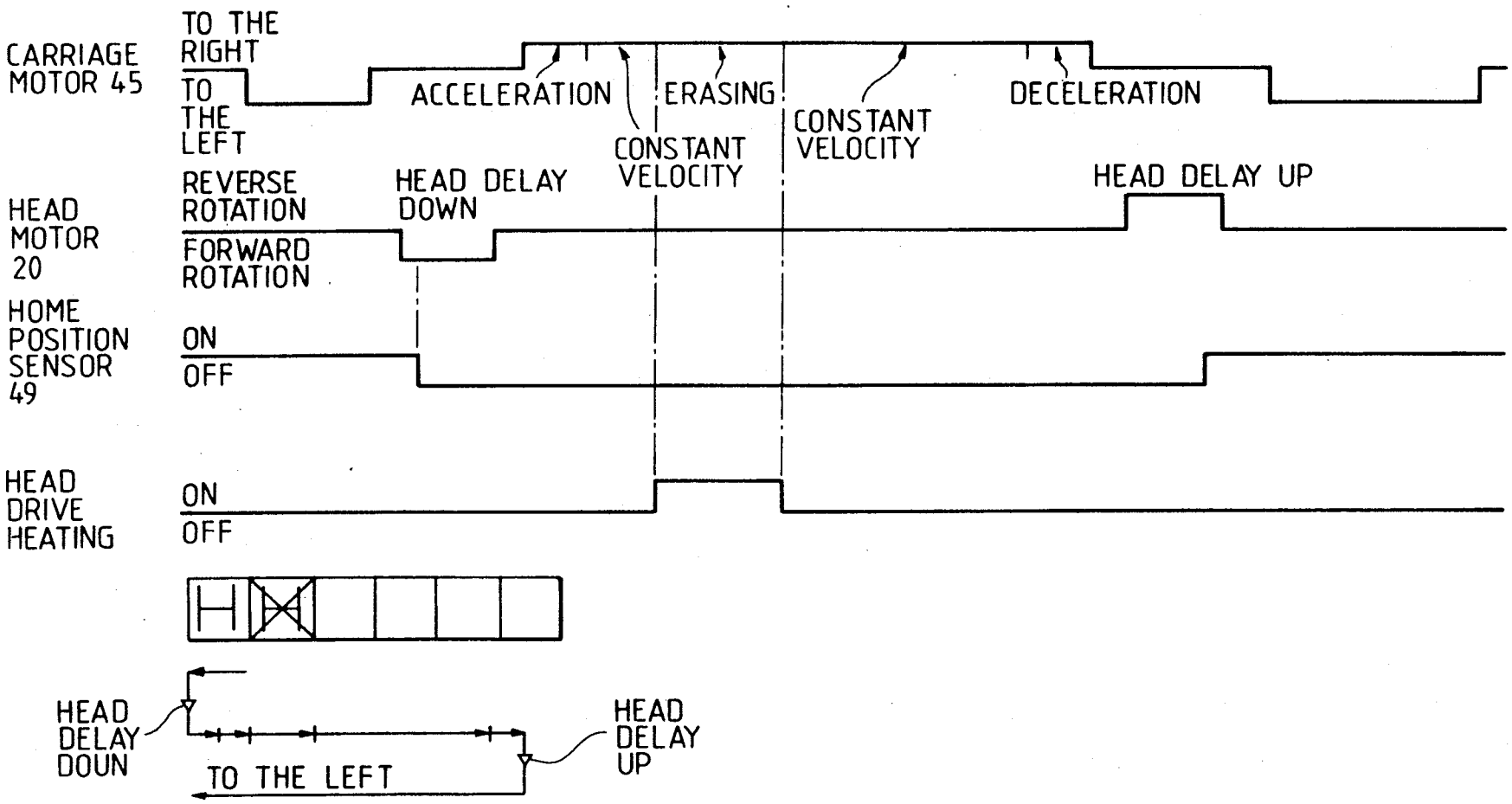
FIG. 20 is a timing chart showing an operation for erasing a printed character by using a correction ribbon.

FIG. 20 is a timing chart for performing an erase operation using the self correction ribbon. FIG. 21 is a partial plan view illustrating an erased state obtained by the operation of FIG. 20.

In order to erase characters recorded on the sheet 212, the operator depresses an erase key on the keyboard 215 to start the erase operation. The carriage 28 is moved to the left of the erase start position by a distance corresponding to an approach run.

Figure 21A:
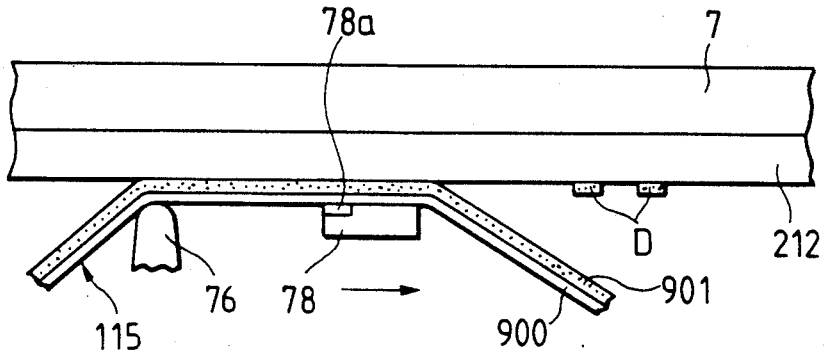
FIGS. 21A and 21B are illustrative plan views showing states wherein erasure is performed.
Figure 21B:
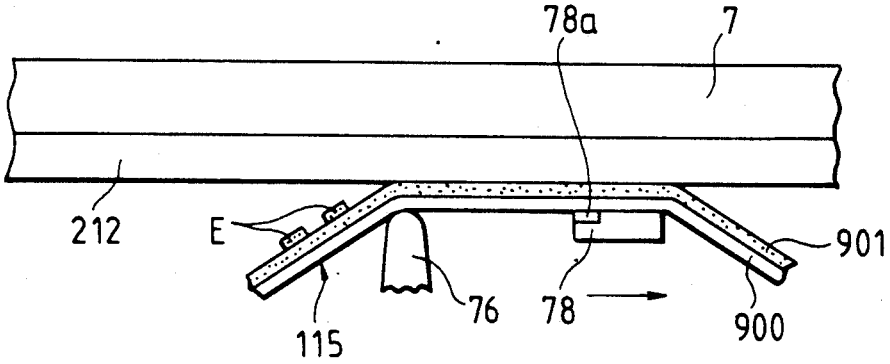

The head motor 20 is rotated in the forward direction. When a predetermined number of steps is counted after the home position sensor 49 is turned off, the head-down operation is started. When a predetermined number of steps is further counted, the delay lever 76 is moved downward. At this time, the carriage 28 performs an approach run and is accelerated. As shown in FIGS. 21A and 21B, the carriage 28 is driven at a constant velocity, and then a voltage is applied to the head 78 at the position of the image D. The heating elements 78*b* are heated to start melting the ink. When the ink is set in a semi-melted state, the printed portion as the image D (i.e., attached ink) is removed from the recording sheet 212 and is attached as an ink E to the ink layer 901 of the ribbon 115. An approach run is performed in the same manner as in post-printing. In this case, until the delay lever 67 passes through the printed portion as the image D, the carriage 28 travels at a constant velocity, as shown in FIG. 20, and then the carriage motor 45 is stopped.

As shown in FIG. 20, the head motor 20 is rotated in the reverse direction, the home position sensor 49 is turned on, and the head motor 20 is then braked and stopped. The up operations of the delay lever 76 and the head 78 are performed.

Finally, the carriage 28 is moved to prepare for the next printing cycle, and then the erase operation is completed.

A printing operation using a two-color ribbon will be described with reference to a timing chart of FIG. 22.

Printing using the ink of the first layer of the two-color ribbon is the same as that using the ink of a monochromatic ribbon.

Figure 22:
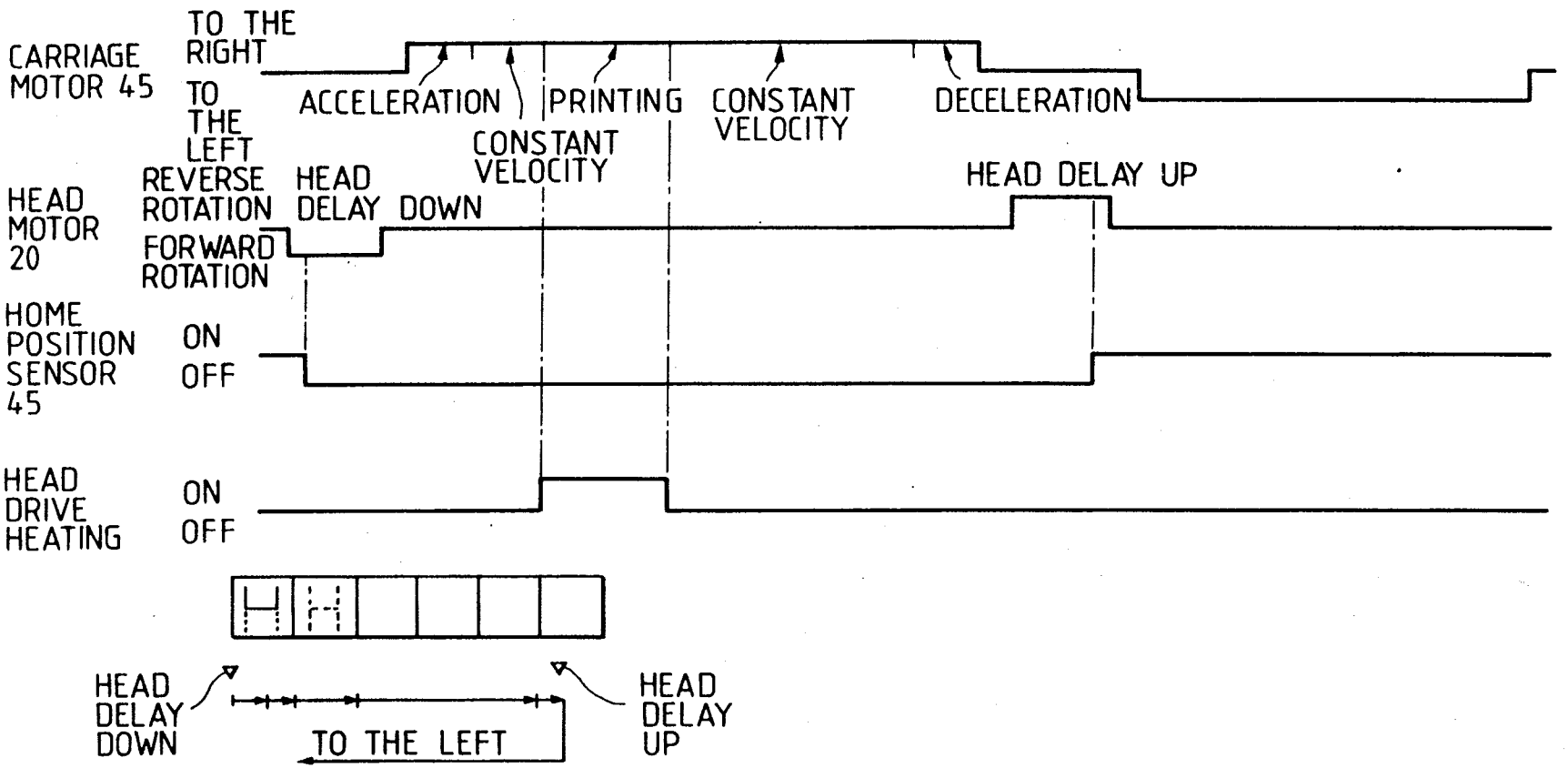
FIG. 22 is a timing chart of a two-color printing operation of the image recording apparatus shown in FIG. 1.

However, the operations shown in FIGS. 22 are performed for printing of the ink of the second layer. These operations are basically the same as those (FIG. 20) using the self correction ribbon.

More specifically, in order to delay separation of the ribbon 115 from the recording sheet 212 upon printing, the delay lever 76 is moved downward, as shown in FIG. 20. A series of operations, i.e., the down operations of the head 78 and the delay lever 76, printing with the carriage 28 being moved to the right, the up operations of the head 78 and the delay lever 76, and movement of the carriage 28 to the left, are performed to complete printing.

Figure 23:
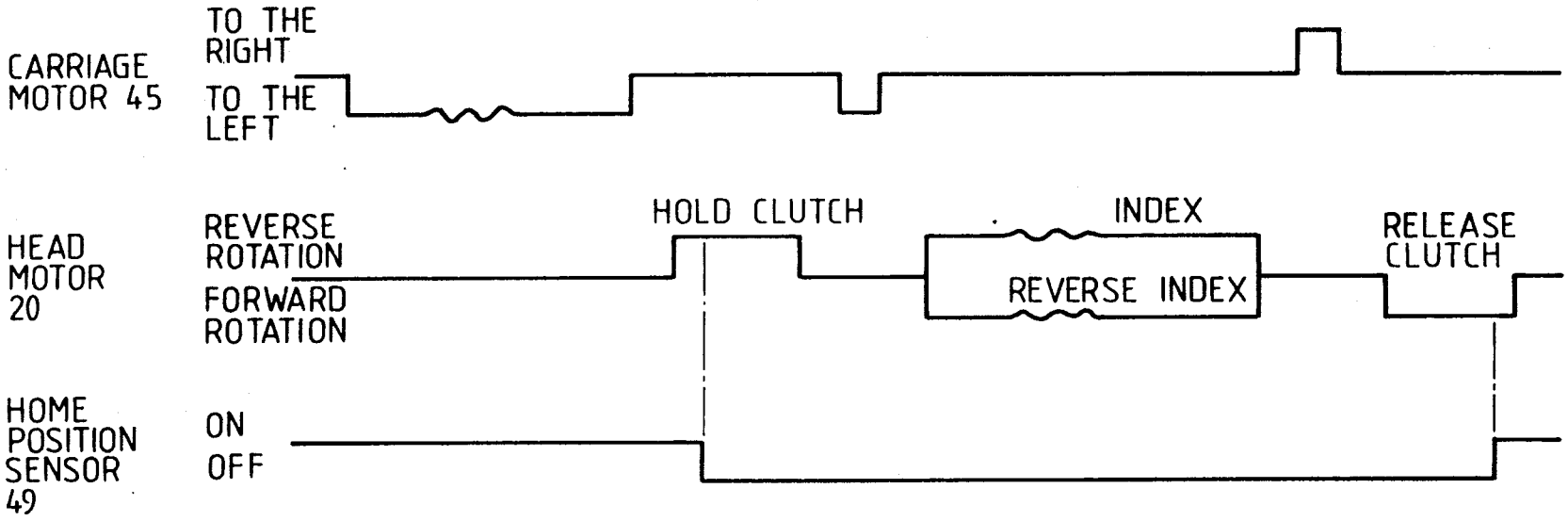
FIG. 23 is a timing chart showing a sheet feed operation in the image recording apparatus shown in FIG. 1.

A convey operation of the recording sheet 212 will be described with reference to a timing chart of FIG. 23.

In order to convey (feed) the recording sheet, the RETURN key, the INDEX key, the REVERSE INDEX key which are arranged on the keyboard 215 are used. When the carriage 28 is located at a position except for the left end, the operator depresses the RETURN key to drive the carriage motor 45, thereby moving the carriage 28 to the left end.

Sheet feeding as described above will be performed as follows. The head motor 20 is rotated in the reverse direction to hold the clutch rack 27 by the clutch lever 29. The carriage motor 45 is driven to slightly move the carriage 28 to the left. The head motor 20 is connected to the paper feed (PF) rollers 3 through the selection gear 22. The head motor 20 is rotated in the forward and reverse directions to perform the index and the reverse index operations.

The carriage motor 45 is driven to slightly move the carriage 28 to the right (the carriage 28 is turned), and the cams I 69 and II 70 are directly coupled to the head motor 20. The head motor 20 is rotated in the forward direction to release the clutch rack lever 29. The feed operation (paper feed operation) of the recording sheet 212 is completed.

The present invention is not limited to the thermal transfer recording system described in the above embodiment. The present invention is also applicable to a heat-sensitive recording system or an electrorecording system. The recording head is not limited to the thermal head described in the embodiment. For example, an electrorecording head or the like may be used in place of the thermal head. In addition, processed paper, heat-sensitive paper, or an OHP sheet may be used in place of normal paper.

According to the embodiment as has been described above, there is provided an image recording apparatus for recording an image on a recoding sheet, comprising: a recording head for recording the image on the recording sheet; a carriage for holding the recording head, the carriage being reciprocated along a platen; a convey means for conveying the recording sheet; a motor for applying a drive force to perform an up/down operation of the recording head so as to drive the convey means; a drive force transmission switching means displaceable to be engaged with the carriage at any position with a reciprocation range of the carriage; and an engaging means for causing the carriage to engage with the switching means, wherein driving of the convey means and the up/down operation of the recording head by the motor are switched therebetween. Therefore, the mode can be easily switched at any position to a mode for feeding the sheet. Therefore, a recording speed can be kept high since quick switching can be performed using even one motor.

We claim:

1. An image recording apparatus for recording an image on a recording sheet, comprising:

a reciprocatable carriage for moving a recording head for recording an image on the recording sheet in a direction across a conveyance direction of an ink sheet;

conveying means for conveying the recording sheet;

a motor for applying a drive force to said conveying means for conveying the recording sheet and a drive force for causing the recording head to move between a recording position where the recording head performs image recording and a retracted position where the recording head is retracted from the recording position; and switching means capable of switching between the drive force for conveying the recording sheet and the drive force for moving the recording head between the recording position and the retracted position at any position of said carriage within a reciprocating moving range of said carriage.

2. An apparatus according to claim 1, further comprising a regulating plate for guiding the recording sheet, and an upper cover of said carriage, said regulating plate being formed integrally with said upper cover and comprising a scale for indicating the position of the recording head with respect to the recording sheet.

3. An image recording apparatus for forming an image on a recording sheet, comprising:

a reciprocatable carriage for moving a recording head for recording an image on the recording sheet in a direction across a conveyance direction of an ink sheet;

a loading portion for loading thereon an ink sheet having an ink to be transferred to the recording sheet;

conveying means for conveying said carriage and the ink sheet; and a biaxial motor for causing one shaft thereof to transmit a drive force to said conveying means for reciprocating said carriage and causing the other shaft thereof to transmit a drive force to said conveying means for conveying the ink sheet loaded on said loading portion.

4. An apparatus according to claim 3, further comprising a regulating plate for guiding the recording sheet, and an upper cover of said carriage, said regulating plate being formed integrally with said upper cover.

5. An apparatus according to claim 3, wherein the ink sheet has a charge thereon, said apparatus further comprising:

a flexible conductive cable connected to the recording head; and a conductive discharge member contacting the ink sheet to discharge the ink sheet, said conductive discharge member being connected to said flexible cable to discharge the ink sheet through said flexible cable.

6. An image recording apparatus for recording an image on a recording sheet, comprising:

a reciprocatable carriage for moving a recording head for recording an image on the recording sheet in a direction across a conveyance direction of an ink sheet;

conveying means for conveying the recording sheet;

a motor for applying a drive force to said conveying means for conveying the recording sheet and a drive force for causing said recording head to move between a recording position where the recording head performs image recording and a retracted position where the recording head is retracted from the recording position;

switching means for switching said motor between applying a drive force to said conveying means for conveying the recording sheet and applying a drive force for moving the recording head in accordance with movement of said carriage;

a cam member for moving the recording head between the recording position and the retracted position in response to receiving a drive force from said motor; and a sensor for detecting a stand-by position of said cam member and a home position of said carriage.

7. An image recording apparatus for recording an image on a recording sheet, comprising:

a reciprocatable carriage for moving a recording head for recording an image on the recording sheet in a direction across a conveyance direction of an ink sheet;

a motor for applying a drive force for conveying the recording sheet and a drive force for causing the recording head to move between a recording position where the recording head performs image recording and a retracted position where the recording head is retracted from the recording position;

switching means for switching said motor between conveying the recording sheet and moving the recording head in accordance with movement of said carriage;

a torque shaft for transmitting the drive force, for causing the recording head to move, from said motor to said carriage and the recording head;

a flexible cable for transmitting a control signal to the recording head to control recording by the recording head;

a carriage frame having a through hole through which said torque shaft for transmitting the drive force to said carriage extends; and a projection outwardly extending around said through hole, said projection being engaged with an opening formed in said flexible cable, thereby mounting said flexible cable to said carriage.

8. An image recording apparatus for recording an image on a recording sheet, comprising:

a reciprocatable carriage for moving a recording head for recording an image on the recording sheet in a direction across a conveyance direction of an ink sheet;

means for conveying the recording sheet and the recording head;

a motor for applying a drive force to said conveying means for conveying the recording sheet and a drive force to said conveying means for causing the recording head to move between a recording position where the recording head performs image recording and a retracted position where the recording head is retracted from the recording position;

switching means for switching said motor between conveying the recording sheet and moving the recording head in accordance with movement of said carriage, wherein said carriage further comprises a member;

a flexible cable for transmitting a control signal to the recording head for controlling recording by the recording head;

a carriage frame attached to said carriage having a through hole therein;

a shaft fitted in the through hole formed in said carriage frame to support said member of said carriage; and a press member for mounting said flexible cable to said carriage frame, said press member also serving to prevent removal of said shaft.

9. An image recording apparatus for recording an image on a recording sheet, comprising:

a reciprocatable carriage for moving a recording head for recording an image on the recording sheet in a direction across a conveyance direction of an ink sheet;

conveying means for conveying the recording sheet;

a motor for applying a drive force to perform an up/down operation of the recording head and so as to drive said conveying means;

drive force transmission switching means which is displaceable and is adapted to be engaged with said carriage at any position within a reciprocation range of said carriage; and engaging means for causing said carriage to engage with said switching means, wherein said drive force transmission means switches said motor between driving said conveying means and the performing of the up/down operation of the recording head.

10. An apparatus according to claim 9, further comprising a platen with respect to which said carriage is reciprocated, wherein the ink sheet has ink contacting the recording sheet during recording by the recording head, wherein said apparatus further comprises a delay lever, pivotal about a central line parallel to said platen, for delaying a time for separating the ink sheet from the recording sheet after recording is performed by the recording head, and means for interfacing with said delay lever to permit delaying the time for separating the ink sheet from the recording sheet.

11. An apparatus to claim 9, further comprising an elastic member and a shaft, wherein said conveying means comprises a drive rotary body including a first rotary member which can be brought into contact with and separated from said drive rotary body, a second rotary member which can be brought into contact with and separated from said drive rotary body, and a support arm for rotatably supporting said drive rotary body, said first rotary member causing said elastic member to urge said support arm so as to come into contact with said drive rotary body, and said second rotary member causing said elastic member to urge said shaft to come into contact with said drive rotary body.

12. An image recording apparatus for recording an image on a recording sheet by using an ink sheet having an ink thereon, comprising:

a reciprocatable carriage for moving the recording head for recording an image on the recording sheet in a direction across a conveyance direction of an ink sheet;

a drive source for performing conveyance of the ink sheet and reciprocal movement of said carriage;

a drive force receiving portion for receiving a drive force for taking up the ink sheet;

a drive force transmitting member displaceable to transmit the drive force of said drive source to said drive force receiving portion; and an arm having a pivot center at a position different from a center of rotation of said drive force receiving portion, said arm being arranged to support said drive force transmitting member.

13. An apparatus according to claim 12, further comprising means for causing said drive force transmitting member to engage said drive source and then said drive force receiving portion.

* * * * *

UNITED STATES PATENT AND TRADEMARK OFFICE

CERTIFICATE OF CORRECTION

PATENT NO. : 5,169,247

DATED : December 8, 1992

INVENTOR(S) : SHINYA ASANO, ET AL.

It is certified that error appears in the above-identified patent and that said Letters Patent is hereby corrected as shown below:

COLUMN 3
Line 46, "printer" should read --printer or--.

COLUMN 4
Line 36, "other" should read --other end--.

COLUMN 7
Line 47, "An" should read --A--.

COLUMN 10
Line 54, "the" (second occurrence) should be deleted.

COLUMN 14
Line 30, "cental" should read --central.

COLUMN 19
Line 49, "the" (second occurrence) should be deleted.

COLUMN 24
Line 58, "apparatus" should read --apparatus according--.

Signed and Sealed this

Third Day of August, 1993

*Attest:*

Michael K. Kirk

MICHAEL K. KIRK

*Attesting Officer*

*Acting Commissioner of Patents and Trademarks*